US007699051B2

(12) United States Patent
Gagas et al.

(10) Patent No.: US 7,699,051 B2
(45) Date of Patent: Apr. 20, 2010

(54) RANGE HOOD

(75) Inventors: John M. Gagas, Milwaukee, WI (US); Daniel E. Stair, II, Cedarburg, WI (US); David J. Zeier, Pewaukee, WI (US)

(73) Assignee: Westen Industries, Inc., Watertown, WI (US)

( * ) Notice: Subject to any disclaimer, the term of this patent is extended or adjusted under 35 U.S.C. 154(b) by 831 days.

(21) Appl. No.: 11/147,970

(22) Filed: Jun. 8, 2005

(65) Prior Publication Data

US 2006/0278216 A1 Dec. 14, 2006

(51) Int. Cl.
*F24C 15/20* (2006.01)

(52) U.S. Cl. ..... 126/299 D; 126/299 R; 454/56

(58) Field of Classification Search ..... 126/299 D, 126/299 R; 454/56, 49
See application file for complete search history.

(56) References Cited

U.S. PATENT DOCUMENTS 3,980,072 A 9/1976 Jacobs
4,088,123 A 5/1978 Bowen, Jr. et al.
4,146,016 A 3/1979 Bowen, Jr. et al.
4,266,528 A 5/1981 Barnhart et al.
4,373,509 A 2/1983 Neitzel et al.
4,450,756 A * 5/1984 Kling ..... 454/67
4,467,782 A 8/1984 Russell
4,475,534 A 10/1984 Moriarty
4,501,260 A 2/1985 Grace
4,549,052 A 10/1985 Simon
4,551,600 A 11/1985 Miyagawa et al.
4,586,486 A 5/1986 Kaufman
4,604,110 A 8/1986 Frazier
4,700,688 A 10/1987 Searcy et al.
4,759,272 A 7/1988 Zaniewski
4,784,114 A 11/1988 Muckler et al.
4,821,704 A 4/1989 Tucker et al.
4,825,848 A 5/1989 Macias
4,889,104 A 12/1989 Gostelow
4,903,685 A 2/1990 Melink
5,002,040 A 3/1991 MacFarlane
5,020,511 A 6/1991 Liu
5,042,456 A 8/1991 Cote
5,050,581 A 9/1991 Rohl-Hager et al.
5,139,009 A 8/1992 Walsh
5,167,572 A 12/1992 Etkin
5,190,026 A 3/1993 Doty
5,196,040 A 3/1993 Malloy et al.
5,205,279 A 4/1993 Brown
5,220,910 A 6/1993 Aalto et al.
5,230,327 A 7/1993 Jang et al.
5,232,152 A 8/1993 Tsang
5,251,608 A 10/1993 Cote
5,253,804 A 10/1993 Sarazen, Jr. et al.
5,257,736 A 11/1993 Roy
5,267,897 A 12/1993 Drees
5,271,377 A 12/1993 Rouleau
5,279,279 A 1/1994 White (Continued)

*Primary Examiner*—Alfred Basichas
(74) *Attorney, Agent, or Firm*—Boyle Fredrickson, S.C.

(57) ABSTRACT

A hood for a cook top is controlled preferably by an electronic controller through a touch keypad. The hood has front and side walls and attaches to a back wall. It has an internal cavity and structure to restrict airflow out of the hood. The structure also creates an air curtain. The curtain traps and moves heated air and effluents upwardly off of the cook top. At least one blower is located near the cook top for moving the air and effluents. The hood may also have at least one: filter, sensor, duct, lighting fixture, vent, display, and circuit board.

19 Claims, 10 Drawing Sheets

U.S. PATENT DOCUMENTS 5,282,770 A 2/1994 Shibata
5,322,470 A 6/1994 Vartiainen et al.
5,323,761 A 6/1994 Vartiainen et al.
5,421,776 A 6/1995 Sakamoto et al.
5,429,116 A 7/1995 Brown
5,515,840 A 5/1996 Jang
5,522,377 A 6/1996 Fritz
5,540,744 A 7/1996 Renna
5,577,490 A 11/1996 Overton, Jr.
5,642,784 A 7/1997 Guay et al.
5,713,346 A 2/1998 Kuechler
5,720,661 A 2/1998 Yoshizawa et al.
5,738,083 A 4/1998 Pettinari
5,803,072 A 9/1998 Strand
5,860,412 A 1/1999 Way
5,884,619 A 3/1999 Terry
5,890,484 A 4/1999 Yamada
6,041,772 A 3/2000 Ward et al.
6,041,774 A 3/2000 Ward et al.
6,058,929 A 5/2000 Fritz
6,067,980 A 5/2000 Kahlke et al.
6,173,710 B1 1/2001 Gibson et al.
6,182,653 B1 2/2001 Otenbaker et al.
6,218,654 B1 4/2001 Braunisch
6,230,980 B1 5/2001 Hudson
6,235,090 B1 5/2001 Berstein et al.
6,267,112 B1 7/2001 Chiang
6,276,358 B1 8/2001 Brin, Jr. et al.
6,341,601 B1 1/2002 Ward et al.
6,344,074 B1 2/2002 Ward et al.
6,347,626 B1 2/2002 Yi
6,349,716 B1 2/2002 Morton
6,454,834 B1 9/2002 Livingstone et al.
6,506,109 B1 1/2003 Bastian et al.
6,551,185 B1 * 4/2003 Miyake et al. ..... 454/234
6,569,007 B2 5/2003 Bastian et al.
6,620,038 B1 9/2003 Kikuchi et al.
6,621,058 B1 9/2003 Kim
6,622,717 B1 9/2003 Kim
6,632,132 B1 * 10/2003 Kikuchi et al. ..... 454/66
6,634,939 B2 10/2003 Johnson
6,647,978 B1 11/2003 Khosropour et al.
6,648,937 B1 11/2003 Nguyen et al.
6,692,346 B2 2/2004 Bastian et al.
6,698,419 B2 3/2004 Lee
6,699,119 B2 3/2004 Boulanger et al.
6,715,484 B2 4/2004 Khosropour et al.
6,723,970 B1 4/2004 Whipple, Jr.
6,732,729 B2 5/2004 Yeung
6,752,711 B1 6/2004 Yeung
6,776,152 B2 8/2004 Lee
6,797,041 B2 9/2004 Brownell et al.
6,802,310 B1 10/2004 Yeung
6,802,311 B1 10/2004 Yeung
6,802,767 B2 10/2004 Kanya
6,807,962 B2 10/2004 Taplan et al.
6,808,545 B1 10/2004 Shuler, Sr.
6,920,874 B1 * 7/2005 Siegel ..... 126/299 R

* cited by examiner

RANGE HOOD

BACKGROUND OF THE INVENTION

1. Field of the Invention

The present invention relates in general to the field of kitchen appliances and more particularly to an improved range hood. Specifically, a preferred embodiment of the present invention relates to a range hood having a blower located over a heating element, wherein the blower removes cooking effluents and aids in the recirculation of air toward the cook top to an air curtain around the cook top to trap the effluent.

2. Discussion of the Related Art

The below-referenced U.S. patents disclose embodiments that were at least in-part satisfactory for the purposes for which they were intended. The disclosures of all the below-referenced prior United States patents in their entireties are hereby expressly incorporated by reference into the present application for purposes including, but not limited to, indicating the background of the present invention and illustrating the state of the art.

U.S. Pat. No. 6,551,185 entitled "Air Intake And Blowing Device", pertains to a device with a turbo fan capable of blowing air in a spiral vortex airflow and an intake port for removal.

U.S. Pat. No. 4,475,534 entitled "Ventilating system for kitchen" describes a ventilating system that blows air downward into the front of the hood and also provides a stream in the back at a lower level. An upward directed airflow moves air back into the ventilating system filter area.

U.S. Pat. No. 6,173,710 entitled "Ventilation Systems" relates to a front and two sides for airflow coverage. This system relies on having a wall or physical barriers to provide coverage for the fourth side for air removal.

U.S. Pat. No. 6,620,038 entitled "Suction Exhaust Device" describes a circumference design that also uses fresh air supply for mixing.

U.S. Pat. No. 6,551,185 describes a spiral swirling method for the air curtain and suction action.

U.S. Pat. No. 6,621,058 entitled "Wall-mounted microwave oven with air curtain guide" discloses a front only air curtain.

U.S. Pat. No. 6,058,929 entitled "Adjustable exhaust hood with air curtain" describes a system having two blowers—one for downward flow of air in the front and a second exhaust blower in the back to provide a partial air curtain only to which the sides and back are free to flow out.

Range hoods are of two general types, updraft and downdraft, and within these general categories are ducted and ductless, wall or island hoods. The updrafted, ducted types gather air from above the cooking surface, pass it through a filter where particulates are collected. The air is then channeled into a ducted path and is exhausted to the outdoors. A grease filter is used for removal of some of the grease and particulates. Heat, steam and odors are exhausted to the outdoors in this similar manner.

Present range hoods use a single blower/motor assembly centered in the middle of a range hood for exhausting. Range hoods are centered in the middle of the unit, in order for the hood to draw or create a negative pressure zone for capturing contaminated air. The exhaust blower is sized to draw in the air that is rising and escaping from the work area into the filter. As the size of the range hood gets bigger, the size of the blower must also increase. The blower has to be large in; size, power, speed, and CFM (Cubic Feet per Minute) air movement and thus creates an increase in noise levels. To reduce the noise level, reduction controls have been used. The reduction in output also reduces the ability of the system to effectively draw air into the hood and exhaust. The resulting movement of air outside the hood results in smells, odors, steam, moisture, heat, etc. entering the work area. With the burners located on the outer edges of the cook top range, and the range hood blower/motor located at the center, it is easy to see why the loss of containment can occur.

The controls used presently only provide limited set points in reducing the speed of the motor. They do not provide an unlimited range for setting the proper speed. Moreover, "over-exhausting" may unknowingly reduce home temperatures. It has also blown out flames in appliances and has caused air quality problems.

On the other hand, the ductless types, gather air from the above surface of a range/cooking surface, and pass moisture, effluents, airflow, and temperatures through a filter that collects particulates and greases. This filter is different than the filter used in ducted systems. These filters have a layer of activated carbon charcoal that is either a coating or granules. Because of this activated carbon charcoal layer in the filter, the odor is removed or neutralized as air passes through this layer. The air still carrying heat, steam and some oil/grease, however, is then recycled back into the room by discharging the air through vents in a hood. This makes the user have to move away from the vent opening as it is not a pleasant environment.

Range hoods for the most part are designed so that the front to back dimensions are shorter than the front to back dimensions of a cook top/range. Accordingly, large portions of the front burners are out in front of the top edge of a range hood. As much as 50 percent of the front burners on a range or cooking surface may not be covered by a standard range hood. The reason for this is to permit the user to look into and work on the cooking surface without hitting the range hood. This off-set means that during cooking, steam, smoke, odors, and particulates from the front burner(s) have the ability to pass up in front of the range hood and escape into the room. All blower's motors are centrally located to provide even draw for exhausting, but the flow within this design can be disrupted by any obstruction that enters the hood area including a user's arm. Now add to this a fry pan with low sides and the effective draw zone is at a greater distance from the source and loss of containment occurs. Also the noise level is very high with high speed fans and to some users this level of noise is found to be objectionable. Further, if air streams from outside sources are blowing across a range from an opened door or from a fan in the room, most range hoods cannot provide proper removal of the contaminated air. Major manufactures have attempted to address the above issues of moisture, effluents, airflow, and temperature by blasting a stream of air in a downward flow at the front of the cook top. This is accomplished by blowing air down from the front bottom edge of the hood to create an air pattern that restricts effluents. However, this downward air movement in the front does not accomplish the desired results because air moves out of the captured zone from the sides. Air cannot only move outside the zone from the sides but also out or on to the back wall. Other designs have created a downward flow of air on three sides, but where the back wall collects the grease, moisture, effluents, heat, and temperatures, or it is not contained when an island hood is used. One other method used is to swirl air around in a circle. The problem with this method is that as the air is moving around in a circle if a wall or an item is in the way, stoppage of movement occurs. This stoppage results in a large area of loss entrapment for the contaminated air. This loss then results in the contaminated air being able to escape from a large area and into the room.

Present design range hoods locate the controls on the front or on the under side of the range hood. These controls range from the simplest mechanical switch to a basic electronic control. The mechanical type switches are the rocker, slide, or rotary design. These designs have been around for a long time and are unattractive for high-end units. Such controls are also hard to clean and operate. These switches and controls become coated with grime and functions are reduced. Also, there have been a number of fires as a result of a build up of grease/oils.

The lighting used by most present units is of fixed types, which are directed down. Here, the lights are often not shining in the right location when in use or if one is looking down into the cook top of the range, the user blocks the hood lights. This blocking reduces the light shining on the cook top and in some cases the light is reflected back at the user. When the light fixtures become filled or coated with grease, oils, etc., the lights need to be serviced. To service the lights, some range hood manufacturers have only an incandescent bulb inside that is unscrewed and replaced, others use a single bulb with a plastic shield to protect it. Still other manufacturers use halogen lamps and bulbs to shine light down on the range. The use of halogen type lamps and bulbs pose other problems for cleaning. First, cleaning and replacing is difficult. The lamp types have a glass frame protecting the element and they some times have a metal trim. One must remove the trim to clean or replace the bulb. The other types have a glass lens and bulb inside. If faulty contact is made, the life of the bulb is reduced. The other issue with these types of designs is the ability of the user to do the cleaning and replacement from the underside of the range. Bending over and trying to look under the range hood and clean is not easy, and therefore it is not regularly accomplished. Another issue with using halogen lamps is the cost, which is 3 to 4 times more than an incandescent bulb. A large number of manufacturers only provide a limited number of light levels for the user. These limited light levels are either too bright or too dark. This provides glare or dark spots on the range. The end results of the present lighting methods are generally limited.

There are two families of filter designs. The first designs are the baffle types, which are of a V-shape. This V is both inverted and upright with a gap in between the V for air to move in and around before it goes into the plenum. This design does provide some removal of greases and oils, but a large amount of contaminated air still goes out the duct. This style is used in restaurants and high-end range hoods. The other type is the metal mesh type. Some of these are made of just metal mesh and others also have an activated carbon coating in them. One problem is that most do not tell the user when loss of air removal has occurred. To address this issue on high-end range hoods, manufacturers have added a count down timer for when they believe replacement is needed or cleaning should occur. The filters are timed out ranging from 28 to 30 hours of run time for the range hood for replacement or cleaning. However, this does not address the issue of loss of performance. For example, if the user cooks with a lot of greasy foods, the filters may be plugged sooner than the count-down timing for cleaning would state. On the other hand, if the user does not cook with greases or oils, the alarming would signal change before the filters would need to be cleaned or replaced. Thus, timing on the removal of filters for cleaning or replacement still remains an issue.

The location of heat lamps also poses an issue. That is because they are fitted after the range hood is designed. IR lamps/bulbs for heating or keeping items warm have a very large diameter. The diameter of such a lamp/bulb ranges from 4.5 inches to 7 inches. In taking up such a large area, which reduces the filter area and effective area of containment is reduced. It also reduces the ability to draw contaminated air in.

Finally, in current range hoods, the air flows coming off each of the burners of a range or cook top may be of such strength that they carry cooking moistures, effluents, air, greases, particulates, and heat/temperatures up and around the front, side edges, on to the back wall, or pass by the back if it is an island, and not into the range hood which was intended to collect them.

Therefore, there is a need for a state of the art range hood in which accurate control and removal of moisture, effluent, grease, airflow, particulates and heat/temperature from cooking is Further, there is a need for control(s) to be less susceptible to the environment, and a need for the user to be able to view/see the operation(s), set point(s) functions, speed, and view the contents on the range. There is a need for a remote control, a need to accurately apply and control heat output, as it is returned to the room, and a need for a new design such that it can be used in a variety of places.

SUMMARY OF THE INVENTION

This invention addresses and improves on range hood operation by preferably creating a full 360 degree curtain of air around the cook top to collect and direct the moisture, effluents, airflow, greases, particulates, and heated temperatures into the hood and onto the central exhaust stream. Another aspect of this invention is the ability to place one or more blower(s) for collection at the outer most edges of a range hood so that they are close to the burner elements on the range or cooking surface. This invention further has the ability to treat the heated air from cooking by cooling the air down and capturing the oils, greases, and moisture. It then returns the cooled air back into the room for recirculation or use as part of the air curtain.

These, and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
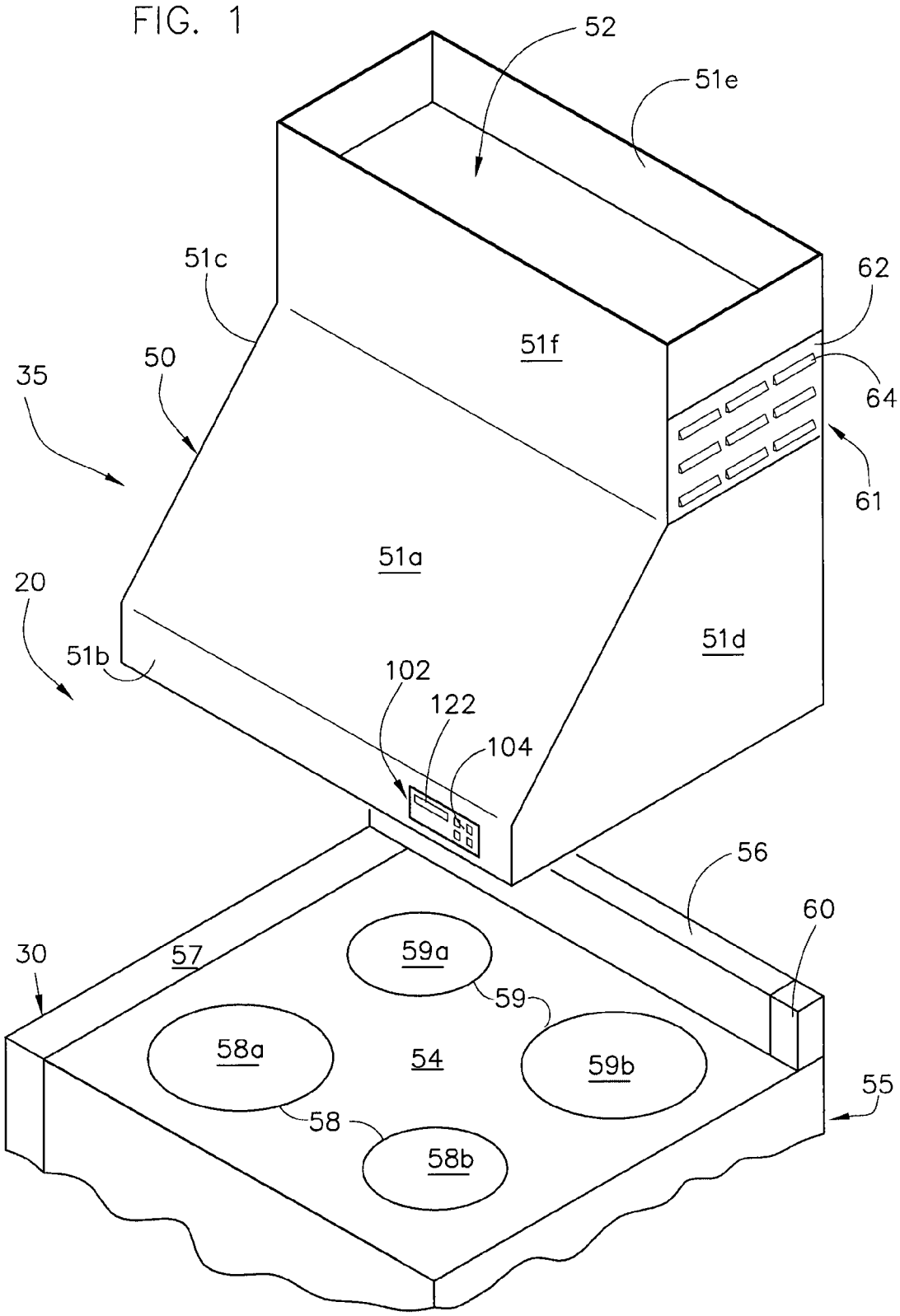
FIG. 1 illustrates a perspective view of the appliance of the present invention.

In describing the preferred embodiment of the invention that is illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the words "connected," "attached," "coupled," and "mounted" and variations thereof herein are used broadly and encompass direct and indirect connections, attachments, couplings, and mountings. In addition, the terms "connected," "coupled," etc. and variations thereof are not restricted to physical or mechanical connections, couplings, etc. Such types of connection are recognized as being equivalent by those skilled in the art.

Further, before any embodiments of the invention are explained in detail, it is to be understood that the invention is capable of other embodiments and of being practiced or of being carried out in various ways. Also, it is to be understood that the phraseology and terminology used herein is for the purpose of description and should not be regarded as limiting. The use of "including," "comprising," "at least one of," or "having" and variations thereof herein is meant to encompass the items listed thereafter and equivalents thereof as well as additional items.

DESCRIPTION OF PREFERRED EMBODIMENTS

The present invention and the various features and advantageous details thereof are explained more fully with reference to the non-limiting embodiments described in detail in the following description.

1. System Overview

This invention relates to the ability to remove contaminated air, moisture, effluents, grease, heated airflows, particulates, and high temperatures and return air that is cleaned and cooled. It also addresses and provides improvement as it relates to upflow range hoods. Also on non-ducted (ductless) upflow range hoods, this invention addresses the return of heated air. This invention covers the different kinds of range hoods like island, wall, chimney, and low profile types.

2. Detailed Description of Preferred Embodiments

Various embodiments of the present invention are shown in FIGS. 1-13 which are described in additional detail below.

FIG. 1 shows one preferred embodiment of the appliance 20 of the present invention. In this embodiment, appliance 20 has a work surface 30. This embodiment is preferably a non-ducted system 35 (which will be described in more detail below). This system 35 has a range hood or collector 50. In this embodiment, range hood 50 is preferably constructed out of several flat panels or walls preferably formed from a metal such as steel. A first panel 51*b* is connected to a preferably angled panel 51*a* that is connected to vertically extending panel 51*f*. Side panels 51*c* and 51*d* are connected to 51*b*, 51*a* and 51*f*. Back panel 51*e* is connected to the side panels 51*c* and 51*d*. These panels are constructed in a box like configuration and form an inner cavity or shaft 52.

Integral with at least one of the side panels is preferably a vent 61 having a vent cover 62 and vent holes 64.

The electronic control panel 102 is preferably mounted on the front wall or panel 51*b*. The electronic control 102 preferably has a keypad 104 and a display 122 built-in to provide a user interface.

The panel or wall 51*a* is preferably angled to increase the effect effluent collection area that extends over the cook top 54. The cook top 54 is part of stove or range 55. The stove 55 preferably has several heating elements. In the preferred embodiment shown in FIG. 1, the front heating elements 58 are a large burner 58*a* and a small burner 58*b*. The back heating elements 59 are a large burner 59*b* and a small burner 59*a*. Alternatively the heating elements may be warmers, glass top cooking pads, a grill top, a built-in griddle, and the like. The cook top 54 may form part of work surface 30 which also may be connected to cabinetry or a counter top 57. In the rear of the cook top is preferably a cooking ledge 56. A cook top sensor 60 is preferably in sensing communication with the cook top 54 and in one preferred embodiment the sensor 60 is connected to ledge 56. Various sensors for the range hood and stove are contemplated and will be discussed further below.

Figure 2:
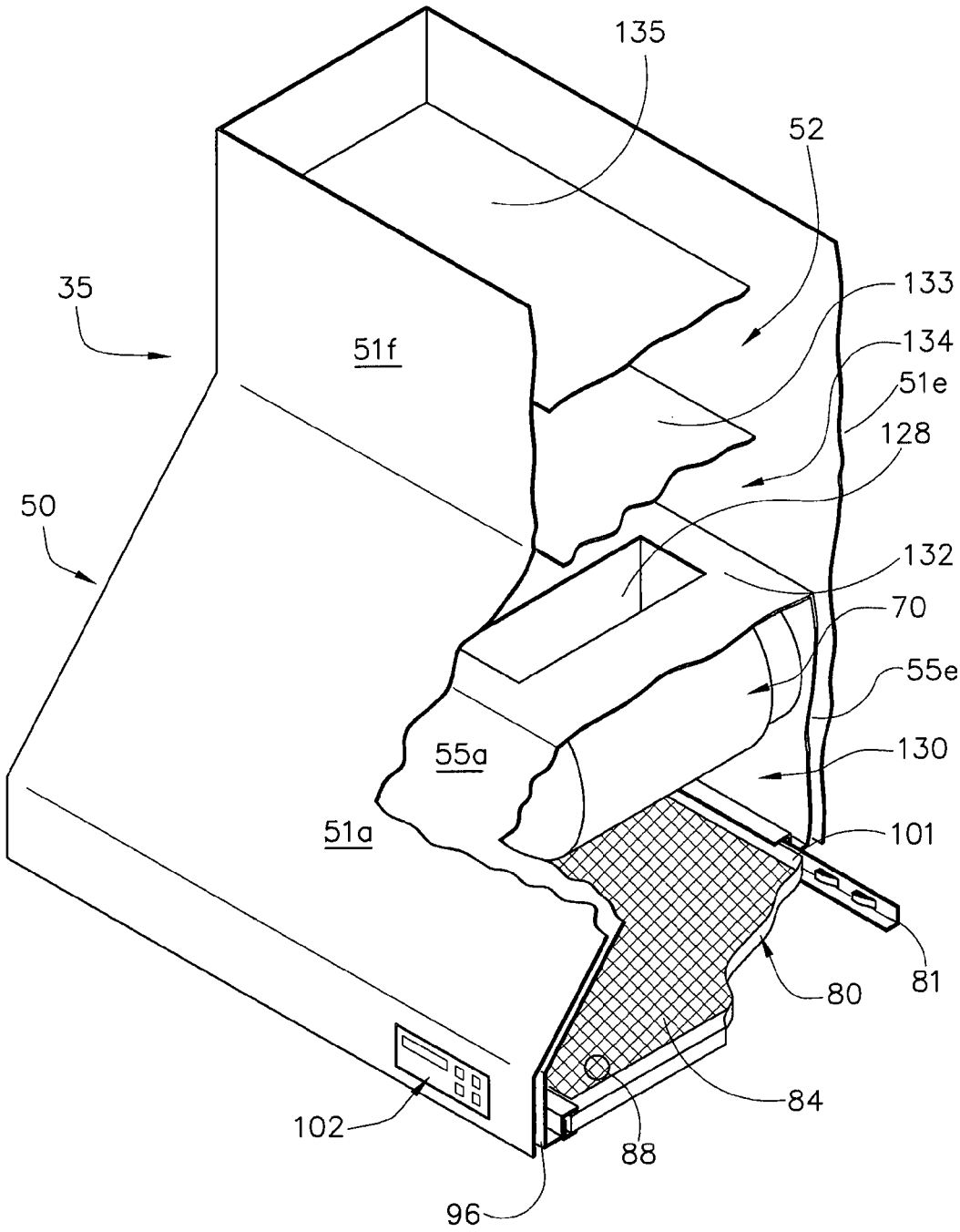
FIG. 2 illustrates a broken away perspective view of the appliance of FIG. 1.

FIG. 2 shows a perspective view of the embodiment shown in FIG. 1 with part of the outer walls of the hood and inner wall broken away. This exposes the inner cavity 52 and inside of hood 50. Preferably parallel to outer wall 51*a*, is inner wall 55*a*. Similarly, inner wall 55*e* is parallel to outer wall 51*e*. These walls preferably connect to a first plate or restrictor 132. Underneath the restricter 132 is a fan or blower assembly 70.

A filter assembly 80 preferably is located at the bottom of the hood opening 101. The filter assembly 80 includes a filter 84 and a filter sensor 88 as well as a filter frame 81. The frame assembly 80 may be slid in and out of this opening when it needs to be cleaned or replaced. Between the filter 84 and the restrictor 132, is a plenum chamber 130. The restrictor 132 preferably has an opening or hole 128 therein to allow a minimum of air to flow out of the plenum chamber 130.

Fan assembly 70 preferably helps draw the air out of the plenum chamber 130. Above the chamber 130, is a pressure chamber 134. The pressure chamber 134, is above a second plate 133. In one embodiment, there is a third plate 135. The plates 133, 135 help prevent air from rising upwardly and out of the hood. The plates 133, 135 preferably now channel filtered air through a passageway 96 between the inner wall 55*a* and outer wall 51*a* and inner wall 55*e* and outer wall 51*e*. Although not shown, other passageways are created behind walls 51*c* and 51*d* between these outer walls and an inner wall. Upon leaving the passageway 96, the air is circulated downwardly back toward the cook top (not shown). Because of the arrangement of the walls and passageways, a 4-sided air curtain is formed. Also, one blower assembly 70 is preferably located directly above each cook top burner. This allows for more effective and efficient removal of effluent from the cook top and into the range hood.

Figure 3:
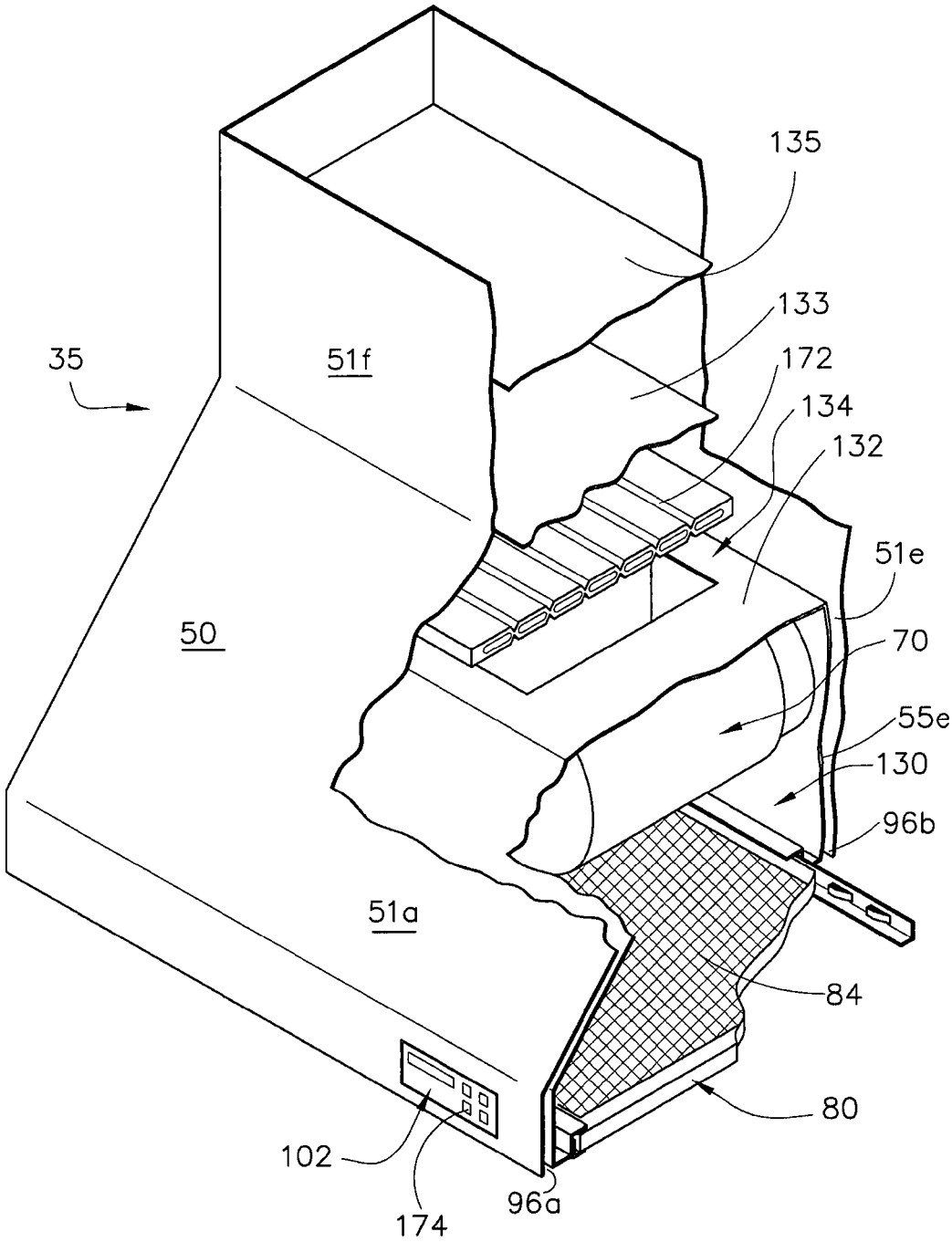
FIG. 3 illustrates a broken away perspective view of another embodiment.

FIG. 3 shows an embodiment of the present invention that is very similar to that shown in FIGS. 1 and 2. However, this embodiment includes a heat exchanger 172 that is located in the pressure chamber 134 preferably between first plate 132 and second plate 133. As mentioned, the blower assembly 70 preferably pushes air from the plenum chamber 130 upwardly into the pressure chamber 134. As this embodiment has heat exchanger 172, the air is preferably cooled before it is circulated through a passageway or channels 96*a* and 96*b* located between the outer walls 51*a*, 51*e* and the inner walls 55*a* and 55*e*. This embodiment preferably also includes the heat exchanger switch 174. In this embodiment, the heat exchanger switch 174 is located on electronic control device 102.

Figure 4:
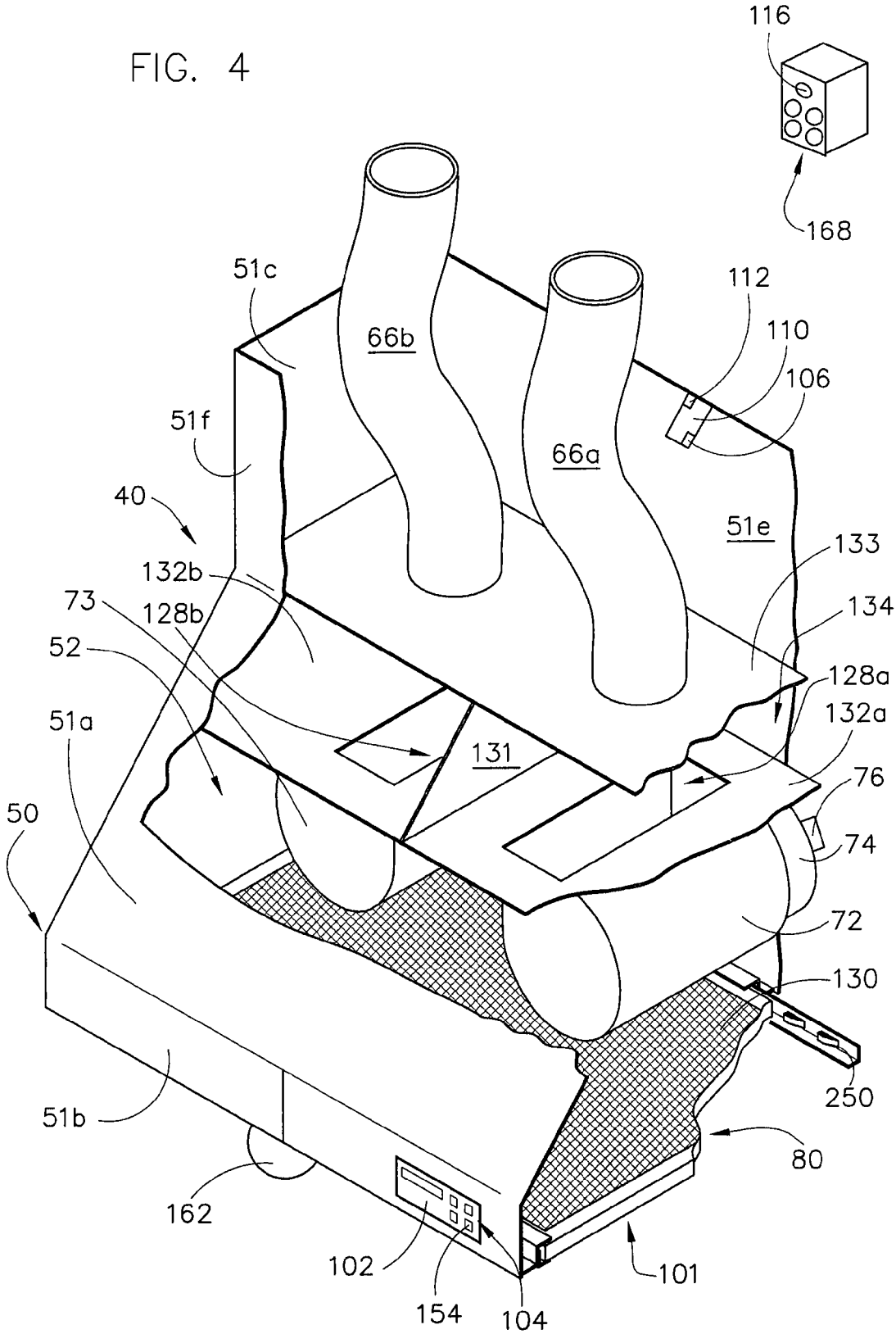
FIG. 4 illustrates a broken away perspective view of another embodiment of the appliance of the present invention.

FIG. 4 shows a ducted system 40 for range hood 50 of the present invention. This embodiment has its outer and inner walls broken away so that the inner cavity 52 may be viewed. At the bottom of range hood 101 is again a filter assembly 80. Above the filter 84 is a first chamber 130 and above the first chamber 130 are two blowers 72, 73. The blowers each preferably have a regulator 74 and a fan sensor 76. The sensor 76 preferably senses fan speed, but may be used to sense fan heat, dirt on the fan, flow rate or fan efficiency. In this embodiment, there is one blower per burner because there are just two burners beneath the blowers (not shown).

Each fan 72, 73 is preferably connected to a panel 132*a* and 132*b*, respectively. Each panel 132*a*, 132*b* preferably has a hole 128*a*, 128*b* respectively therein to allow air to pass from first chamber 130 to second chamber 134. The second chamber 134 may be divided in half by panel 131. Panel 131 separates the air pushed into the second chamber 134 from the fans or blowers 72, 73. Second panel 133 is above the second chamber 134. Mounted in openings in the panel 133 are ducts 66*a* and 66*b*. This embodiment also shows electronic control panel 102. In this embodiment, the operation control panel 102 includes an operation selection device or button 154 which may be located on the keypad 104. This embodiment also shows a remote controller 116 which may include a computer chip. The remote controller may have added functionality and include a processor and a memory. In one embodiment, the remote controller with a processor, WIFI or BLUETOOTH connection, and a memory may be a hand held personal computer or personal digital assistant (PDA). Such a device would interface preferably with a programmable controller 112 that is mounted on the range 50 so the user can remotely control, operate, and view data the range's operation. The programmable control 112 preferably includes a computer processor chip 106 which interfaces with the remote control 116. A control circuit board 110 is also preferably present. A fire suppression system 162 preferably includes a sensor, an alarm, and a fire extinguisher. The system 162 is preferably controlled by circuit board 110. This system will be described more later.

Figure 5:
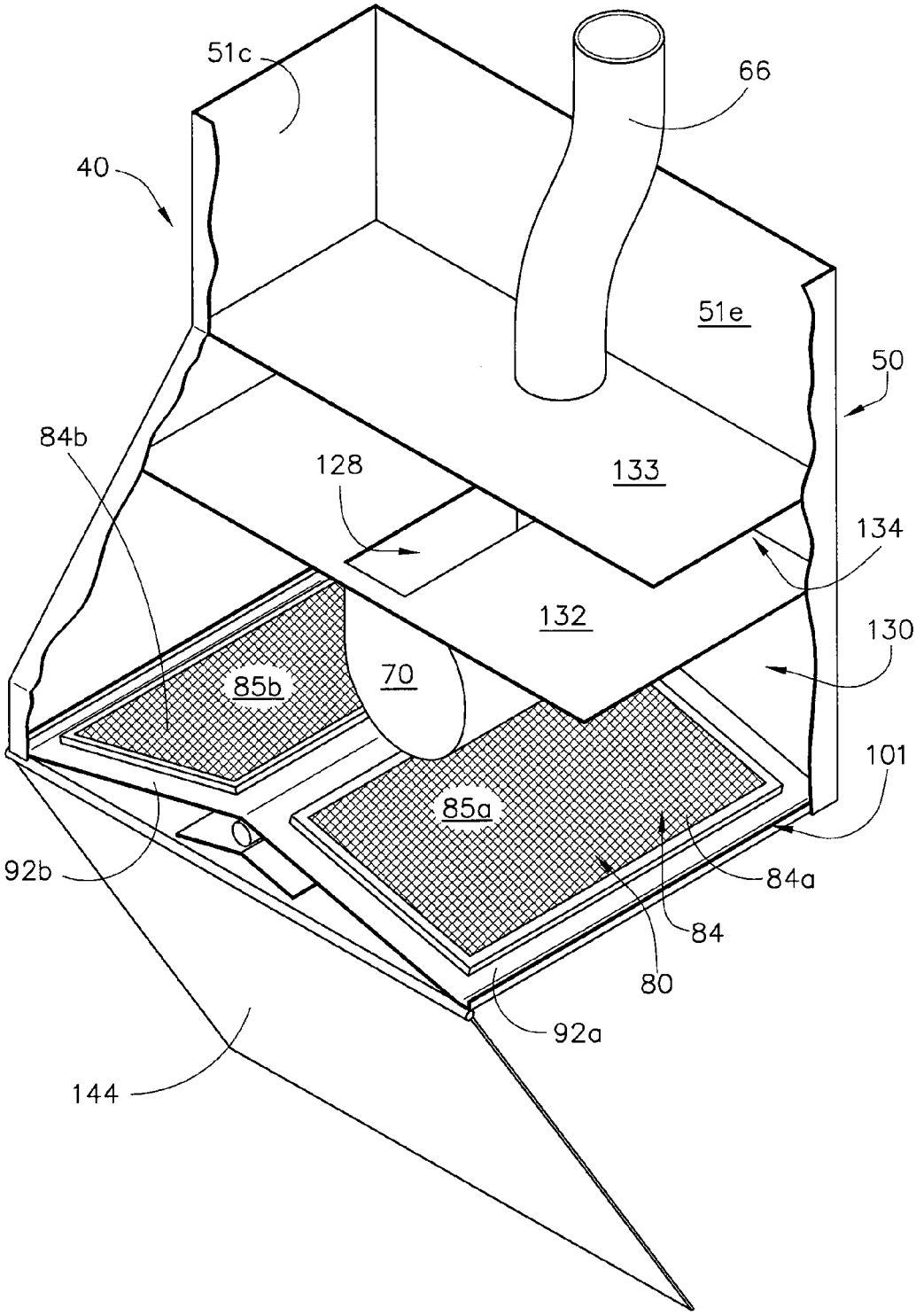
FIG. 5 illustrates a broken away perspective view of yet another embodiment.

The embodiment shown in FIG. 5 is also a ducted system 40. Here the range hood 50 only includes one duct or exhaust tube 66. The duct is mounted in a hole in plate 133 which is above cavity 134. Cavity 134 is separated from cavity 130 by a plate 132. The plate 132 has a hole 128. Mounted below hole 128 is blower assembly 70. Below cavity 130 is a filter assembly 80. The filter assembly includes a catch or filter 84 which has two parts or sections 84*a* and 84*b*. The sections 84*a* and 84*b* are mounted in the hood opening 101 at an angle on top of a bar and two plates. Each portion 84*a* and 84*b* includes a screen mesh 85*a* and 85*b* as well as a grease or dirt collection surface 92*a* and 92*b*. This embodiment also includes a movable shield or flap 144 that can be folded out from underneath the hood and moved over the cook top (not shown). The shield 144 acts as a collector to funnel effluent from the cook top into the range hood opening 101. When not in use, the shield 144 may be folded back under the range hood 50 into the opening 101 to seal or close the opening. In the closed position, the shield panel 144 prevents warm air from escaping the room in which the hood 50 is located and helps conserve energy.

Figure 6:
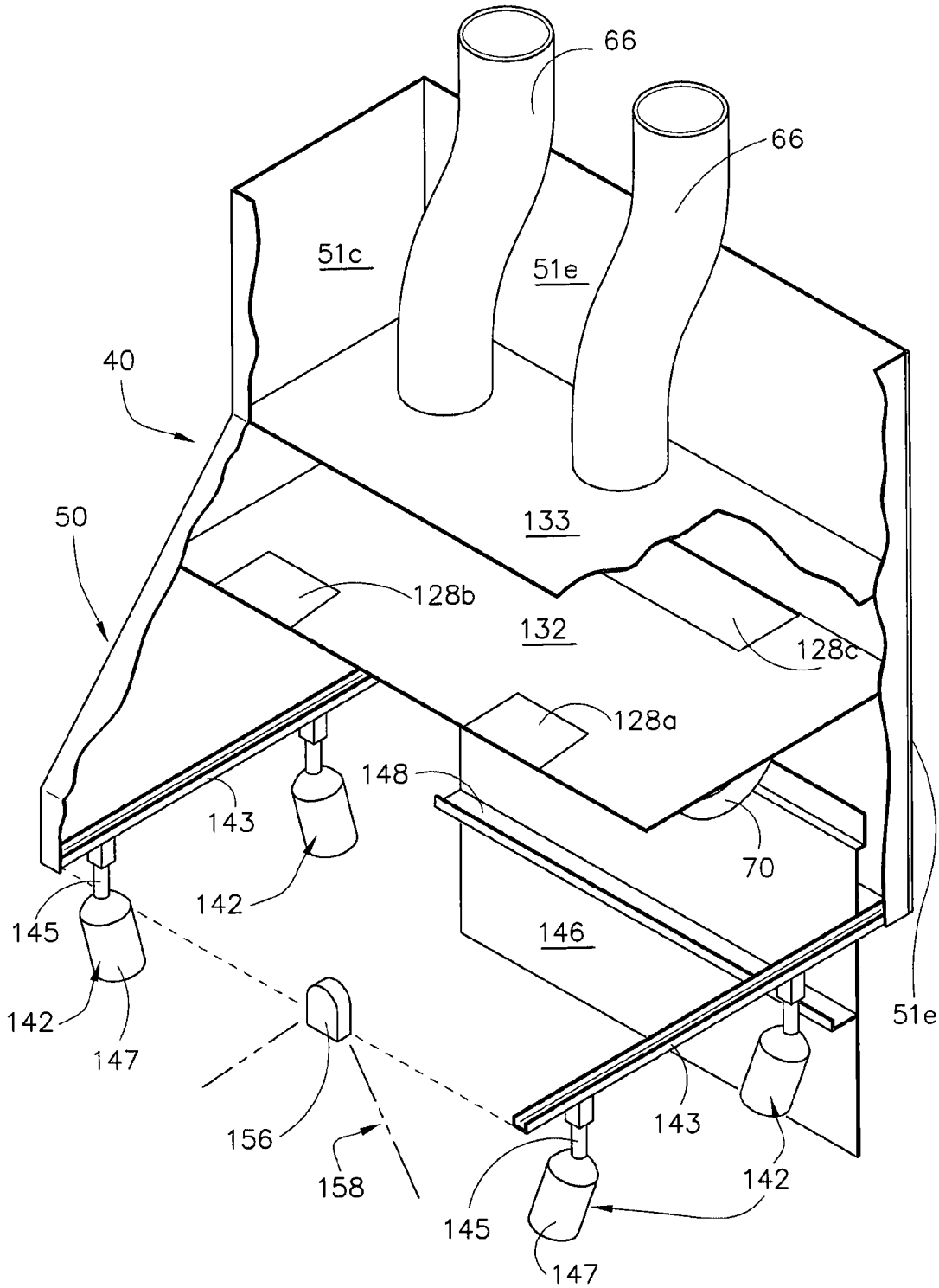
FIG. 6 illustrates a broken away perspective view of still another embodiment.
Figure 7:
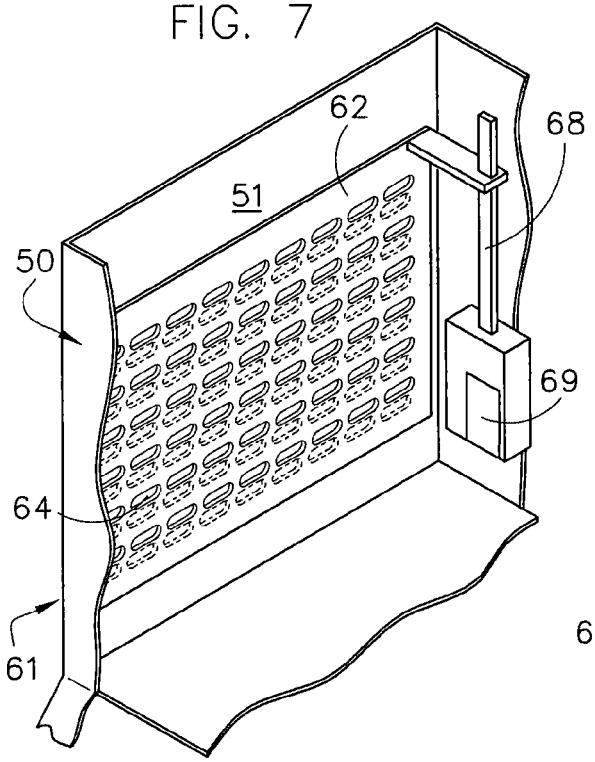
FIGS. 7-10 illustrate magnified broke away views of various embodiments of a vent cover of the present invention.
Figure 8:
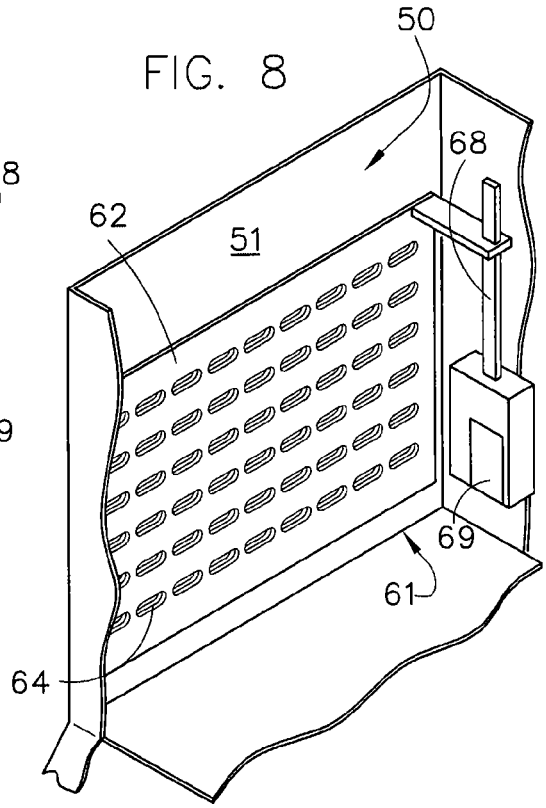

FIG. 6 shows another embodiment of the present invention. Again, a ducted system 40 is shown. In this embodiment, hole 128 is located at the back of the panel 132. Here, the blower assembly 70 is also located toward the back of the range hood and below the hole 128. This embodiment has lighting 142. Preferably, the lighting 142 is mounted in tracks 143 so that the lighting may move back and forth along the tracks from the front of the range hood to the back of the range hood 50. The tracks may be arranged under the hood, along the perimeter, or arranged in a wide variety of patterns to maximize the light available. Each light 147 is preferably mounted on an arm 145 which can be turned to allow the lights to be focused in different areas on the cook top. Preferably, the arm 145 also allows the light 147 to completely move from the left position to a right position. Many more lighting arrangements are possible. These will be discussed in greater detail below.

The embodiment shown in FIG. 6 also shows a back panel or shield 146. The back panel or shield 146 is preferably made of stainless steel. The shield 146 also preferably includes a perpendicularly protruding shelf 148 which may be used to store cooking utensils or spices. The back panel 146 may also have protruding hooks to hold spoons, or other cooking utensils (not shown). A detector or sensor 156 may be mounted at the front of the hood 50. The sensor 156 is preferably an IR sensor system which includes a scanner or beam 158 (as will be discussed, other sensor types are possible). The beam looks down upon the cook top (not shown) and helps determine whether or not the burners are properly operating to heat food in pans or pots on top of the burners. This embodiment also shows that multiple blowers and blower holes 128*a-d* may be present. This is because here each of the four burners (not shown) has preferably its own blower.

FIGS. 7-10 show various venting system configurations. In the embodiment shown in FIG. 7 and FIG. 8, vent 61 includes a vent cover 62 that has a plurality of holes 64 contained therein. An actuator 68 is preferably connected to the vent cover 62. The wall 51 of the range hood 50 also may contain similarly sized holes. When the holes 64 of the vent cover 62 are aligned with the holes in the wall 51, air flows in and out through vent cover 62. However, preferably when power is applied to actuator 68, vent cover 62 slides up or down (or sideways in another possible embodiment) to offset the holes 64 from the holes contained in the wall 51. Once these holes are no longer aligned, the vent 61 is effectively closed (as long as no portion of the holes in the vent are still aligned with holes in the wall). The vent cover 62 and actuator 68 is preferably controlled by the vent cover controller 69 which may include a computer chip or processor.

Figure 9:
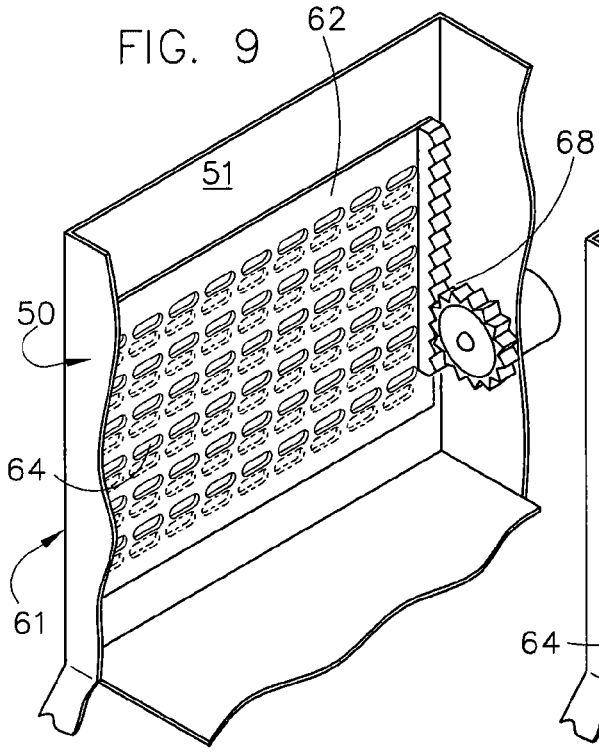

In FIG. 9, vent cover 62 is controlled by gear preferably in communication with a motor. The actuator or gear 68 is connected to teeth on the vent cover 62. Again as the vent cover moves up or down, the holes in the vent cover 64 are brought out of alignment with the holes in the wall 51 and vent 61 is closed.

Figure 10:
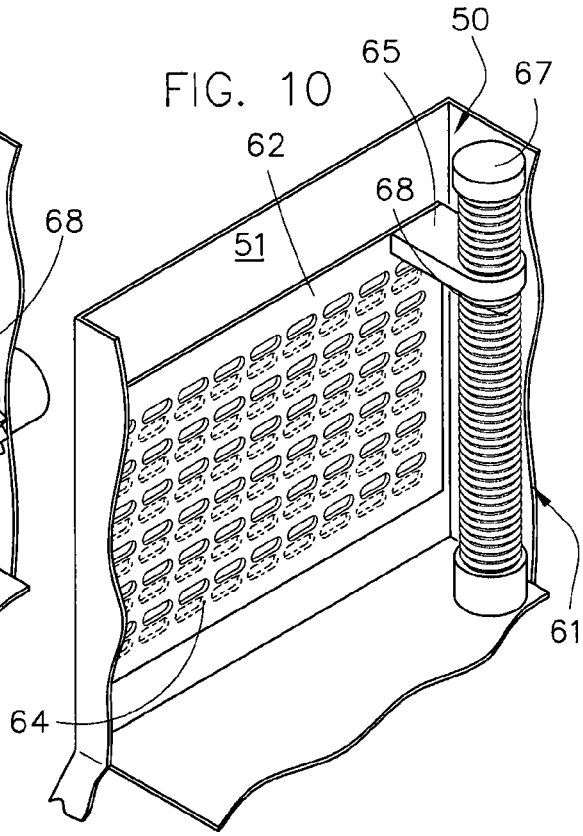

In FIG. 10, the actuator 68 is a screw 67 which is in communication with a member 65 connected to the vent 61. As the screw 67 engages grooves in the member 65, it moves the vent cover 62 up and down. The holes 64 of the vent cover 62 are therefore no longer aligned with the holes in the wall 51 and the vent 61 is closed.

Figure 11:
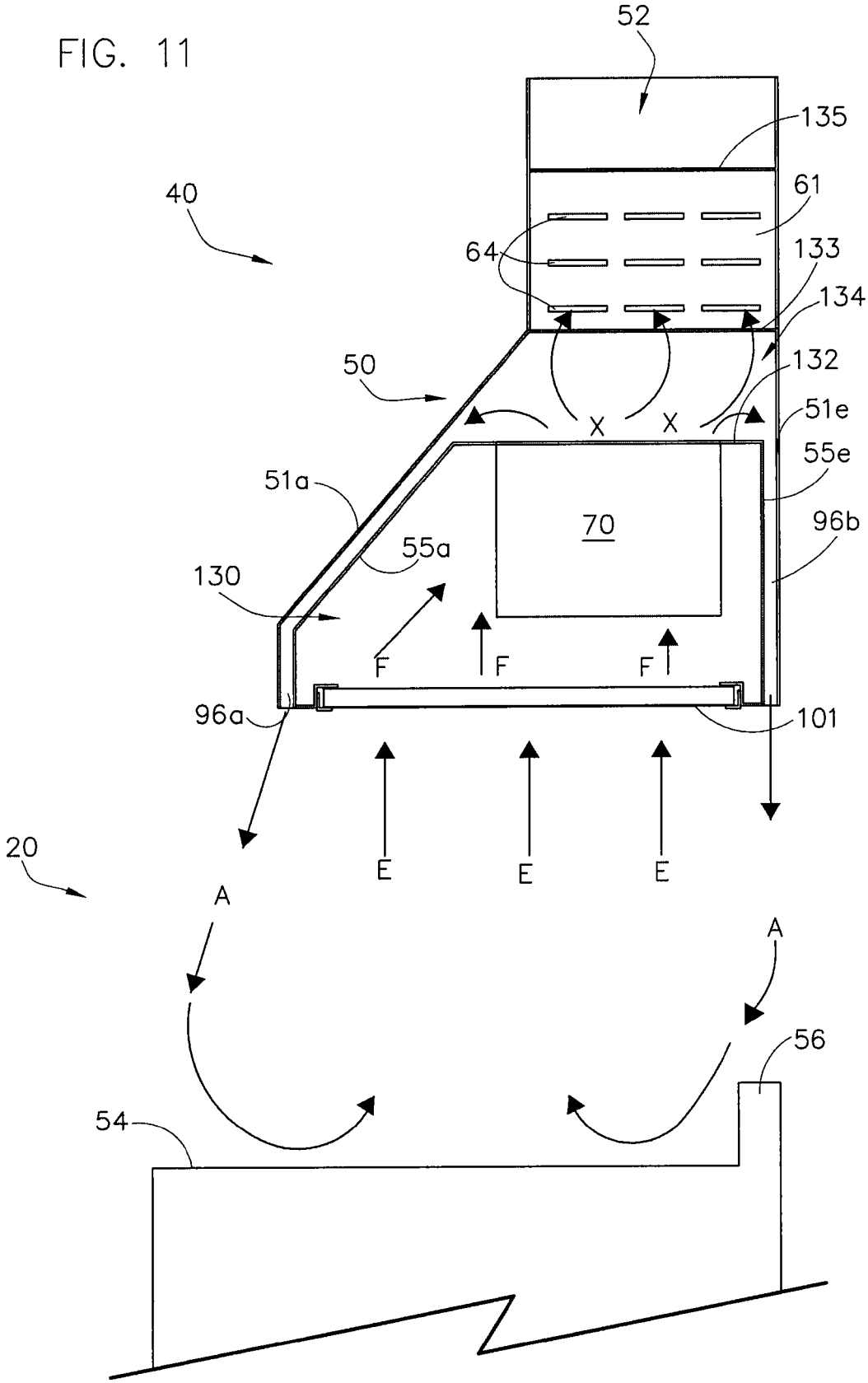
FIG. 11 illustrates a cutaway schematic side view of the embodiment of FIG. 1.

FIG. 11 is a schematic cut away view similar to the range hood 50 and cook top 54 of the appliance 20 shown in FIG. 1 and 2. In this embodiment, effluent (shown by arrows marked E) travels upwardly from the cook top 54. The effluent passes through filter assembly 80 which is located on the bottom 101 of the range hood 50. As the effluent passes through the filter assembly 80, it is cleaned or filtered and becomes filtered air (shown by the arrows marked with an F). Restrictor 132 is at the top of the chamber 130. As mentioned, restrictor 132 preferably has a hole therein so that blower assembly 70 may draw the now filtered air upwardly. Some of this air is exhausted out of the vent holes 64 which are above plate 133 (the exhaust air here the shown by the arrows marked with an X). Third plate 135 is located above vent 61 to cover the top of the shaft 52 and thus force the air out vent holes 64. Some other air, however, is pushed downwardly toward the cook top through a passageway 96*a*, 96*b*. Passageways 96*a*, 96*b* are formed between outer walls 51*a*, 51*b* and inner walls 55*a*, 55*e*. As this drawing is 2-dimensional, it should be noted the air curtain is preferably 4-sided. This recycled and redirected air is shown by the arrows marked A. This air (A) creates an air curtain around the perimeter of the cook top 54. Therefore, no effluent or otherwise "dirty" air is allowed to escape the cook top. Rather, the air is forced upwardly again with the effluent back through the filter.

Figure 12:
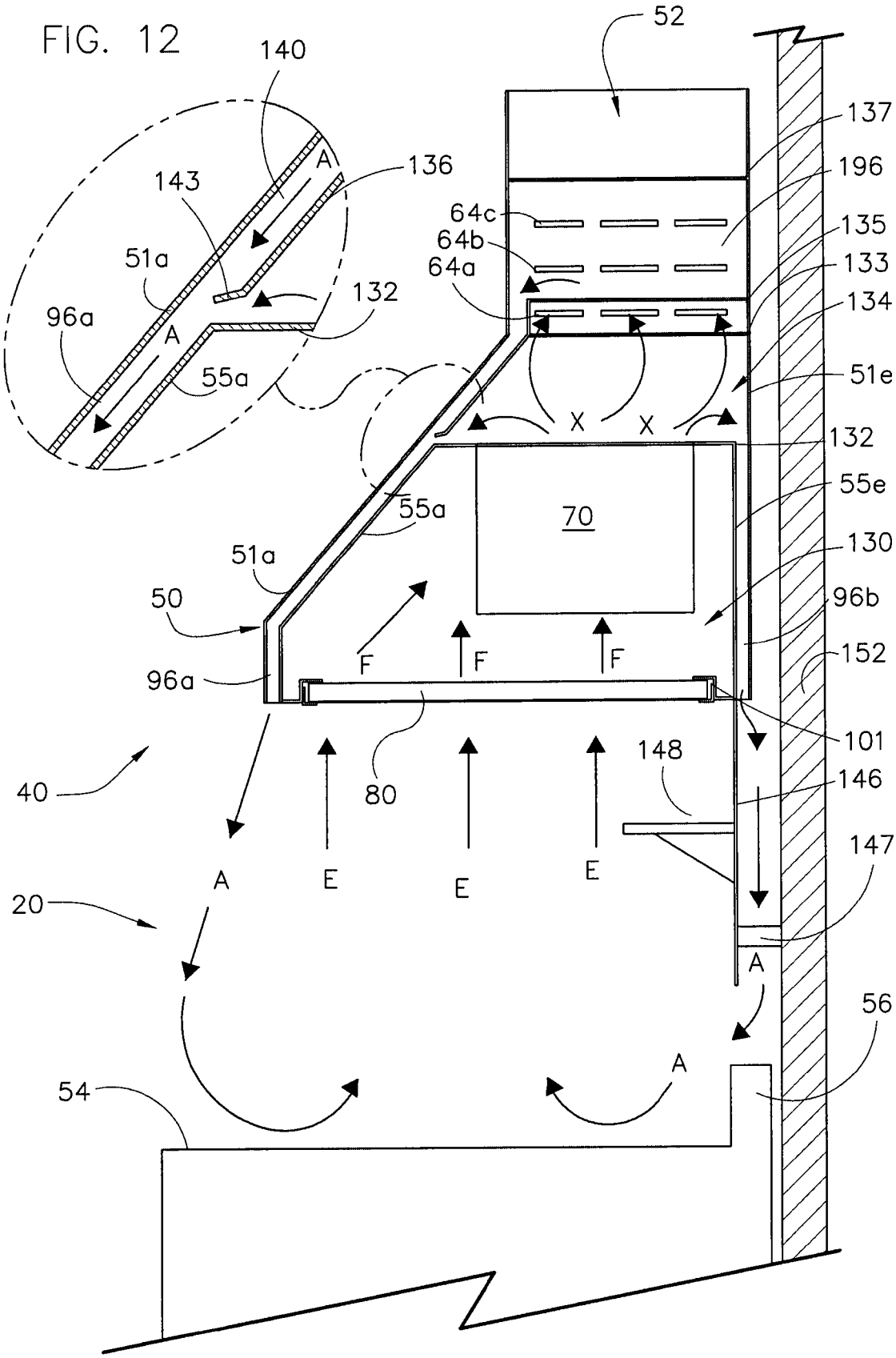
FIG. 12 illustrates a cutaway schematic side view of the embodiment of still another embodiment.

FIG. 12 shows another embodiment of the present invention. This embodiment is a ducted system 40. Here the appliance 20 also contains the range hood 50 and a cook top 54. Again, effluent (E) is drawn upwardly from cook top 54 through filter assembly 80 by blower assembly 70. The blower assembly takes the filtered air and pushes it through restrictor 132 and into the second chamber 134. Plate 133 preferably has some holes therein to allow exhaust air (X) to escape from the first set of vent holes 64*a*. Some of this air however is recycled through a passageway 96*a*, 96*b* which is formed between outer wall 51*a*, 51*e* and inner wall 55*a*, 55*e*. The air from the passageways 96*a*, 96*b* is pushed downwardly toward the cook top 54 creating an air curtain (A). The air curtain traps effluent air and redirects it upwardly through the filter assembly 80 at the bottom 101 of the range of 50. Again, the air curtain is preferably formed along each side of the cook top, e.g., front, back, left and right. The third plate 135 seals off the exhaust hole first set 64*a*.

This embodiment is similar to the embodiment shown in FIG. 6 in that a back panel 146 is present. A shelf 148 may be attached to the back panel 146. At least one spacing block 147 may be added to keep the shelf off of back wall 152. The back plate is preferably 30 inches long. The spacing block 147 preferably is configured in such a way to allow recycled air to pass by as it travels downwardly toward the cook top 54.

Holes 64*b* and 64*c* above the third plate 135 are used as vents to draw in fresh air from the outside. A fourth plate 137 is connected to the range hood above holes 64*b* in 64*c* to seal off the shaft 52. The area between the third panel 135 and the fourth panel 137 is referred to as the recycled air return chamber 196. The enlarged view to the left of the drawing helps better illustrate how the air moves through the second chamber 134. Preferably, as mentioned previously, the outer walls 51*a*, 51*e* and inner walls 55*a*, 55*e* form passageway 96 above plate 132. A raceway or air diversion plate 136 has a bend 143. At this point a Venturi is created by the raceway 136, e.g., the air moves faster around the bend creating a vacuum and drawing more fresh air from the outside and more recycled, treated air from the chamber 134. In the preferred embodiment, there are also passageways formed on the sides of the range hood. These are parallel to the walls 51*c* and 51*d* shown in FIG. 1. Additional elements of specific components of the present invention are discussed in greater detail below.

Preferably, an indoor or outdoor, island or wall, ducted and non-ducted range hood is controlled by an electronic controller, through a touch keypad(s), knob(s), or preset automatic control. The range hood also preferably has dual cross flow, tangential fans for providing precise control and an efficient way of effluent removal. This creates a range hood having a 360-degree perimeter downward curtain of air, which entraps, retains, collects and directs the effluents into a zone of exhaust. The collection blowers are preferably located over or near the burners which are on a cook top/range.

The range hood is preferably comprised of a metal, plastic or other materials for the outer skin of the range hood. Because of the flexibility of the design and the low profile of the blower assembly, the outer shape of the range hood can be styled to meet any requirements.

As mentioned, a filter or catch is preferably used for removal of effluents. The filter may use carbon for removing odors, particulates, greases and oils, and moisture that condensates on the median. Additional filters may also be included. A metal mesh filter also may be used as well as a louver type filter. A combination of these filters with a charcoal may also be used in this application. In a preferred embodiment, the filters are angled to drain fluids off and collect them into a grease trap. The grease trap is preferably U-shaped troughs that are placed at each end of the range hood. These troughs are removable.

In a preferred embodiment shown in FIG. 4, the filter is held in place by a L shaped spring holder 250, which provides the adjustability and retention. The spring provides the ability to remove the filter assembly 80 by pushing the filter assembly into the L shaped spring member compressing it and being able to slip the filter out. This method of holding the filter, also keeps pressure on the filter's edge, trapping it in place and keeping it from making noise due to the vibration. As mentioned, the filter preferably has a sensor or filter change device that signals replacement based preferably on airflow and not on time.

The sheet metal/material construction of the housing has been designed to accommodate the lighting system as mentioned above. This design allows any type lamp holder to be installed in a convenient way. For example, in one embodiment, by twisting a male connector to the female connection, a fixture is locked in place. The female connection can be designed into the housing providing a fixed point. Adjustable tracks may provide movement of light and adjustability of light for rotation and horizontally movement. The use of a track system permits movement from front to back or front left to right. Track lay out on the under side of the range can be a singular strip to many strips. For example, one strip of track may be down the middle, two strips of track on the outside edges, three strips of track one on the other edge, and one in the middle. Alternatively, four strips of tracks in a layout may run around the outer edge of the range hood. See FIG. 6. One skilled in the art will see that there are a number of methods for laying out a track. With a track system, the movement of the light assembly provides the user the ability to place the light assembly at any location. Thus, providing lighting at the best angle.

Another novel invention to the track system is the ability to swing the track out beyond the range hood under side and provide lighting at different angles from outside the range hood. Lighting may also be on a bendable, moveable arm, e.g., a snake light system.

Preferably, housed within the range hood's outer frame of metal/plastic or other material is an opening to provide the viewing of an electronic display. The electronic display may also include the control board electronic(s), see, e.g., FIG. 1, panel 102. The electronic board is preferably attached to the material by bolts and nuts within a viewable window, but could be held in place by other methods like adhesive, tape, connector, etc. The wiring for the panel preferably is shielded from being seen and being contaminated by dirt that may coat the wires.

Sensor(s) for the detection of the temperature are preferably located on the underside of the range hood and directed downwardly for the sensing of the items placed on the cook top or the range. See, e.g., FIGS. 4 and 6. These sensor(s) protrude out from bottom locations of the hood underside covering material. Alternatively, the sensor, e.g., sensor 60, may be located at or near the cook top as shown in FIG. 1. The sensors are connected to control board via wires or a wireless connection. The appliance of the present invention preferably has at least one sensor. The sensor may form part of a sensor system that includes one or more of the following: a pot detector system, an IR detector system for heat, smoke, fire and/or distance, humidity, a gas (e.g., hydrocarbons, CO, CO2) detector, a pressure sensor, moisture or steam sensor, and temperature or thermal sensing technology such as RTDs (resistance temperature detectors), integrated circuit sensors (IC), thermistors, IR thermometers, bimetallic, and thermocouples. Other sensors may include: Any electronic ac or dc sensor used for detecting movement, UV reflectance, resistance, flow, item detection, voice, power or other sensor for the detection and control of the range hood blower with electronics. Also, a sensor may be used for detecting and control of speed for both the fan/blower and the drive mechanism. Finally, an airflow sensor may be provided to detect the flow of air past the filter(s) (See, e.g., FIG. 2, sensor 88). This feature preferably measures the airflow and indicates to user the need for filter replacement or cleaning due to restricted airflow.

Of course, any IR/thermometer that can measure objects that move, rotate, or vibrate (e.g., web process or any moving process) may be used in addition to the ones mentioned above. Such IR sensors are useful as they do not damage or contaminate the surface of the object of interest and they measure the temperature of the actual product being used on a cook top or range and not some of the other parts of the surfaces. Further, the thermal conductivity of the object being measured such as glass, metal, wood, or even very thin objects does not present a problem, as is with other sensors. Response time of these sensors is in the millisecond range, which gives the user more information per time period. Any other electronic IR sensor used for detecting temperature, resistance, heat/fire, distance, moisture/steam, or power for detection and control of the range hood blower with electronics may also be used.

As mentioned above, the material constructed to make the range hood forms an inside cavity and inner wall to which cross flow fan/blowers are able to be attached. In one embodiment, a plate is attached to the blower/fan assembly. This plate provides sealing of an outer cavity from the inner cavity except through the blower and may be removed for cleaning. The inner cavity allows the return of treated air by way of the outer perimeter passage. Also, in the plate are openings that allow air to pass by the outer edges of the range hood. These opening connect to the small passageways that are formed by material sheets that cover the inner cavity around the circumference. At the bottom of the passageway where the air is returned to the work area, the opening is reduced and angled to provide a high velocity/rate of flow at the perimeter. This downward airflow provides a curtain of air that preferably develops a 360 degrees curtain to contain contaminated air flowing from the cook top.

In a ducted type range hood, there is a duct that is used for venting air to the outside. See, e.g., FIGS. 4-6. This duct can be attached at the top, back, or directed downward to the floor in a room, or have a chimney cover the duct at the top. In order to maintain the proper pressure for the air curtain, a restrictor is used to provide the back flow pressure needed to divert the air from exhausting to the passageway.

In a non-ducted type range hood, there is no duct that is used for venting air to the outside. See, e.g., FIGS. 1-3, 11, 12. This non-duct unit can be vented at the top, back, front or directed downward to the floor in a room at the back. A chimney may cover the unit and vent slots may provide venting for the treated air. In order to maintain the proper pressure for air to be returned for the air curtain, a restrictor may also be used to provide the back flow pressure needed to divert the air from exhausting. In both designs, power venting may be used to control the airflow.

A cross flow fan/blower assembly preferably provides the drawing force needed to pull contaminated air up into the range hood and to return the treated air to the work area by way of the 360 degree air curtain and/or to exhaust the air to the outside. The assembly is preferably composed of a housing mounted to the plate. Attached to the housing is the drive motor. A wheel assembly contains the bearings, hub and a wheel of either the skewed or straight bladed type. A fastener connects the wheel assembly to the motor.

Ductless Operation

In a ductless embodiment, a turning fan blade preferably draws air through an angled grease filter/charcoal filter into a first chamber and then through the fan and into a second chamber, pressurizing it. The air is then passed downwardly through the air curtain passageways or ports at the front, sides and back edges of the bottom of the hood, i.e., the perimeter. The air coming from these ports creates a high velocity air curtain stream of 360 degrees, which entraps the effluents into the containment exhaust area of intake air stream. This entrapment carries all cooking effluents through the filter where particulates are collected and odors are removed/neutralized. The front air stream is angled out so as to capture the contaminated air from the front of the burners, which are located out beyond the range hood's perpendicular area of draw. As the air curtain's stream of air slows, the air is moved into the center for drawing upwardly.

The 360 degrees high velocity air curtain causes a low pressure zone in the middle (Bernouli's Principle). As the range hood blower motor draws air from this space or containment zone, effectiveness is increased and the strength of the burner's plume currents is overcome.

Placing the blower motors as close to being directly over the burner element location further increases the effectiveness of drawing contaminated air up. This increase in effectiveness permits the size of the blower motor to be reduced. Thus, the blower's noise level is reduced. To reduce the noise level even more and increase the effectiveness, a cross flow blower is preferably used. In one embodiment, the blower housing height from the cook top is adjusted by a telescoping member which moves the blower closer to the work surface.

Ducted Operations

In a ducted embodiment, the turning fan blades draw air through the grease filter into the plenum or first chamber. Some of the air passes through the passage to the chamber, while most goes through the discharge duct opening out to the duct. The proportion of this split is controlled by the size of the front passage.

The air that goes to the first chamber is pressurized. The air then passes downward through the air curtain passageways or ports at the front, back and side edges at the bottom of the hood. The front air stream is angled forward in order to provide coverage of the front burners. The air coming from these ports preferably creates a high velocity 360-degree air curtain, which is pulled into the main intake air stream. Effluents, such as particulates, grease and oils are also collected. As the air curtain's stream of air slows, the air is redrawn into the center for drawing up. This high velocity air curtain causes a low-pressure zone in the containment area. The range hood blower motor then draws air from this space into the range hood for exhausting. Again, this greatly improves the hood's effectiveness in overcoming the strength of the burners plume currents. This also addresses the issue of outside air currents and obstructions, which does not affect the area, as air is forced downward. For example, when a person reaches in, the air going down wraps around the person and still provides containment.

As mentioned, blower/motor specifications may significantly influence the performance and reliability of the hood units. The use of cross flow (or tangential) blowers provides advantages over other types of centrifugal blower. These advantages include a wide uniform flow of air over the width of the unit without gaps, uniform air delivery for high capacity, and a cross flow wheel geometry that results in a significantly quieter blower/fan. Cross flow blowers provide a smaller profile variable for the same length of exterior housing resulting in a lower profile. Variable speed control may regulate fan speed by using resistors, regulating transformers, and electronic voltage regulators. Those skilled in the art will appreciate and understand that there are other methods for speed and motor control. Other blower design advantages may include overload protection, heat protection if the motor is situated outside the airflow, long bearing life, and high efficiency. In one embodiment, individual draw zones over each burner are created within the hood. See, e.g., FIG. 4. Here the burner specific blowers in the zones provide air flow control within the zone. The air curtain created at the perimeter preferably encloses these zone(s). Blower motor speed over the zone may be reduced with the improved efficiency and thus the noise level may be decreased. This greatly increases the overall efficiency of the range hood. The energy saved from not having to turn on another large blower motor provides added benefits to the user in the way of cost saving. An added benefit is a lower profile due to the more efficient, smaller motor(s)/blower(s) assembly. This gives a person more room for viewing and working under a range hood, or a larger cabinet above the range hood to provide more user space. The fan/blower may also be used for ducting heated air or moisture out. Another aspect of this design is the ability for the fan to be controlled by a humidity sensor, CO, CO2 sensor, and/or hydrocarbon detectors. (See, e.g., FIG. 1, sensor 60). Greater versatility may be had with the use of electronics and the different types exhaust elements. These innovations control the power load for the exhaust hood and only supply that amount of power needed to effectively operate the range hood. Electronics or electromechanical controls may also prevent the spread of fire through regulating electricity flow, blower speed, and heat.

The range hood preferably includes a tangential or cross flow fan/blower that uses an AC or DC drive motor(s). The cross flow blower(s) may use tangential wheels and skewed fan blades, straight blades or other blade designs for the moving of air. Alternatively, a long length axial or centrifugal fan/blower assembly wheel may be used. The fan may be of a fixed or a variable speed with nearly infinite speed setting. As mentioned, the blower is preferably located over each of the burners. With two or more blowers, different size blowers may be used with different cubic feet per minute ratings (CFM). This provides greater effluent removal where needed. If large burner elements are located at the front of a range, this aspect of the invention provides the ability to use a large cross blower (CFM) over those burners to remove the contaminated air. Each fan can be used as a power exhaust vent for removing air, or mixing fresh air with return air, and/or management of moisture/heat buildup. Fan operations may be controlled by a sensor, detector, or switch. Such individualized features allow the range hood to detect the airflow draw needs over each burner and also the amount of draw needed. As the blower draws air upward, it eliminates hot spots or stratified layers of varying temperature(s) over a range's cook top. Alternatively, the fan/blower(s) may be remotely located from the range hood or built on/in with duct work while still providing individual air removal over a burner. These ducts can be closed off to each location and opened when selected by a user or system.

Another aspect of the present invention is the use of mobile lighting to illuminate the work surface. See FIG. 6. This is of great help when trying to view the food or other items on the cooking surface. With this invention, the lights preferably are able to be bent at different angles and are not blocked by the user. A preferred light system is on a track, flexible arm slide, or rail and preferably may be bent to shine in different areas. The lighting system also has the ability to be easily removed and cleaned.

The lighting system is designed to be adjustable from horizontal to 90 degrees vertical and up to 360 degrees of horizontal movement providing precise, effective lighting control. This lighting system is much more user friendly and may be directed for shining in the right location when in use so that if the user is looking down onto the cook top, the user would not be blocking the lights. The track, slide, swing arm or rail system locates the lights where they are needed. Being able to place the light where needed provides complete flexibility and gives the user the freedom to develop the optimum viewing angle for each situation. Low voltage for powering the lights is used to provide the user the ability to safely move lights around.

The lighting system may also have a fixed location but still provide the ability for redirecting the light. For example, this can be accomplished by using different types of connector points built into a range hood. Such built in connectors include: outlet box cover types for hard wiring, canopy adapter types, or any other that allows a lamp holder to be installed by mounting to a connector. Other methods of attachment may be made, e.g., a snap in connector, which locks into a special adaptor like that found in track lighting, a live end type, or floating type, a conduit fitter, or a cord and plug connector. All of these designs may be formed into the metal of a range hood. With the use of low voltage lighting, lights may have the transformer as part of the light heads. This lighting system may also provide a fully polarized and grounded system for added protection. In one embodiment, the light holder may include black Coilex baffles to reduce glare and enhance appearance.

When the light fixtures become filled or coated with grease, oils, etc. servicing is needed. To service the lights of this invention, the user preferably detaches the light, and replaces it without having to work under the range hood. The lamp types may have a glass frame protecting the element and they may have a metal trim. Here, one must remove the trim to clean or replace the bulb. The other types could have a glass or plastic lens and a bulb inside.

This invention preferably provides nearly unlimited light levels for the user to use and addresses the issues of the light being too bright or too dark. Glare and dark spots on the range are also reduced.

According to another aspect of the present invention, indirect light(s) may illuminate the work surface/area. Here, fluorescent, neon, LED lamps are placed behind a reflector so as to be out of view. The light coming from the bulb and reflector is directed to a reflective surface and is reflected down on to the work area and provides an even light over the entire work area.

As can be seen, the range hood may have a variety of different lighting systems to provide light to the cook top including: a moveable light system; aimable lights; a light that may be detached for service and cleaning; lights on rails, slides, or tracks, a light with a nearly infinite range of light levels; a light to illuminate the cavity of the range hood; a light that pivots in any direction for better viewing; a canopy adapter type connection and a tracked light fixture having the ability to rotate and adjust horizontally; a light fixture that may be removed from the range hood by turning the connection and removing the light and fixture for replacement and cleaning; an indirect lighting system to provide a larger work area of coverage by light; fluorescent, shatter resistant, incandescent, neon, LED, or halogen lights; hidden or exposed lights, a series of lights, a mini fluorescent tube, mini neon tube, a series of LED(s), or rope lights, a light located under a flange or on the face of the range hood; a recessed light; a means for turning on, dimming or brightening, and turning lights off, lights with color or colored lenses to create a decorative accent to the cooking area.

Figure 13:
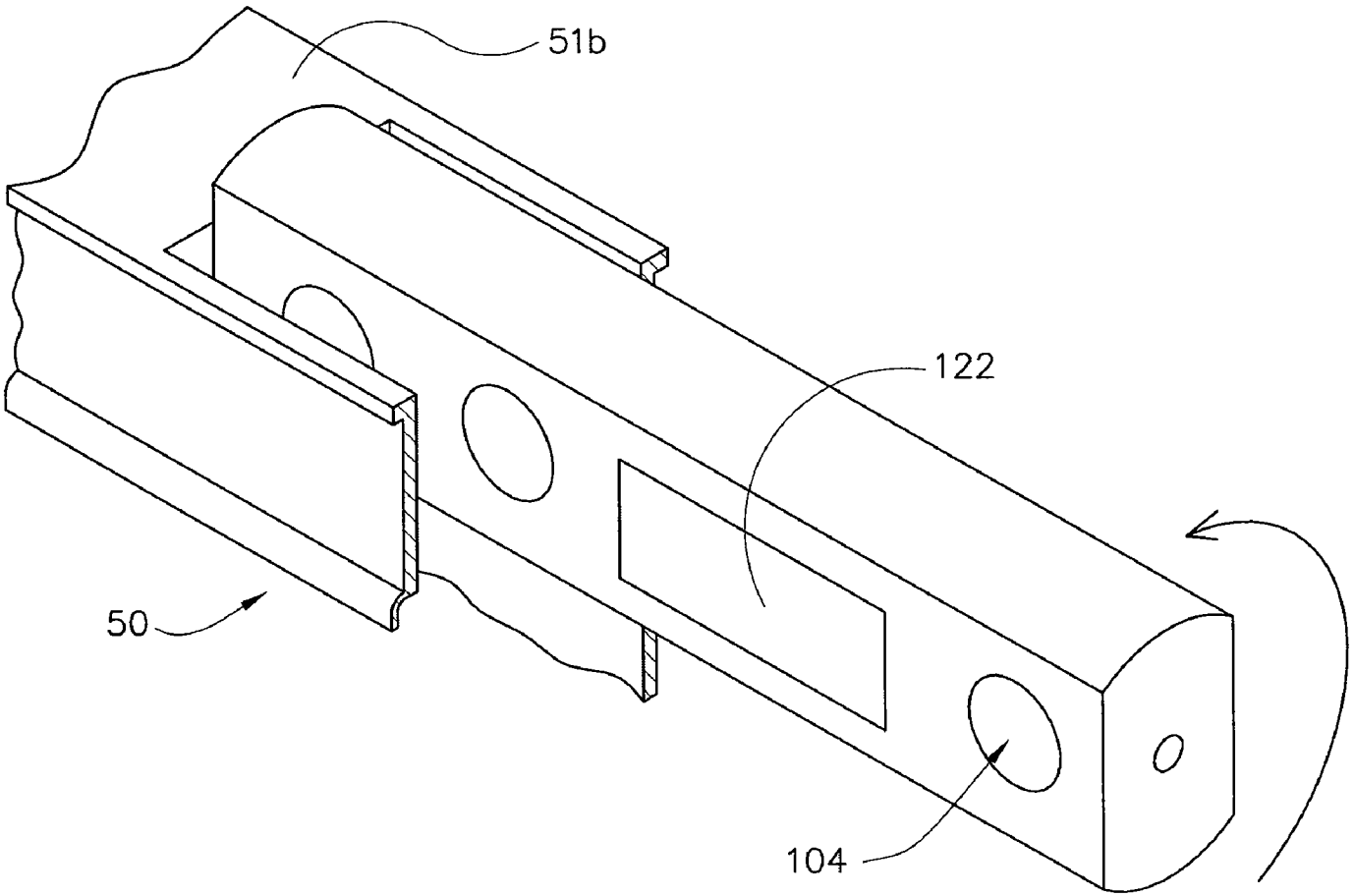
FIG. 13 illustrates a partial perspective view of yet another embodiment of the present invention.

As shown in FIG. 13, unit 20 may have a panel 102 with a display 122 that shows the user speed levels. This can be used to assist in finding proper speeds and heights, which then can be programmed into an electronic control board for repeated operations later. Further, the ability to display to the operator, e.g., the operations, functions, speed, filter life/change, and times using electronics and to accurately control these operations advances the ability to remove contaminated air. Construction of the electronics in a range hood can use, but is not limited to: high heat construction design; specialized adhesive construction; loop resistant circuitry; ESD/EMI/RFI shielding; and LED, LCD, plasma, dot matrix, vacuum fluorescent display(s). All of these can improve the control, display, design, look, and operation of the electronic(s). Electronic touch control panel(s) could use a piezo touch panel (keypad) for selection of operations by operator.

As mentioned, the panel may include an electronic touch controller 104 (e.g., a keypad) that may be made of glass, metal or plastic, with selection of the operating function(s) made by touching the surface of the glass, metal, or plastic. For any size range hood, a resistance type touch control keypad may be used where by touching plastic, metal, or glass at a location causes a change in an electrical signal. The piezo, capacitance, resistance, inductive and tactile membrane switches may be fitted with decorative overlays, under lays, labels, trim and completed control panel assemblies. Touch control key pad(s)/panels may be installed flush, raised, or recessed. Touch control key pad(s)/panels may be installed in any plane and on any surface. Touch controls keypad(s) and display(s) may be placed on the front or top of a range hood to provide the operator with instant viewing of the operations and functions. A remote control may be added by wire or by wireless controls, see, e.g., FIG. 4.

As mentioned, the electronics can provide programmable/selectable set points, programmable/selectable set times, and programmable/selectable set operations as well as set times for both on and off or changes in function(s), set points, speed, or functions. The ability to select multiple functions, operations and times gives the inventive range hood advantages over non-electronic controlled units. This programmability/selectability provides the advantage of being able to enter different functions or operations into the electronic controls and have the range hood respond. Further, an electronic controlled range hood permits more user freedom.

In summary, construction of the electronics in a range hood(s) includes, but is not limited to: high heat construction; specialized adhesive construction; loop resistant circuitry, which is designed for use in membrane switch(s); special edge seal finishing for key pads; ESD/EMI/RFI shielding.

Another aspect of the present invention is a multi-function display. For example, a clock may be on the electronic(s) display when not in use or when in use. See, e.g., FIG. 13. It may also be changed to permit other programmable information to be displayed, such as, messages or computer information. This area may also have an LED night light included in the electronics such that the LED would come on when the room is dark. The use of an LED or a bulb of this type can save energy over the 7 to 15 watt bulbs regularly used as nightlights.

Another aspect of this invention is the ability to have no switch controls. Here, the metal frame of hood acts as the switch. For example, a user may touch the range hood trim top surface in the front or sides and this would operate the ventilator by unfolding it or moving it and turning on the blower. A user may touch the range hood a number of times to speed up or slow down the fan. The user may also touch the range hood and hold for a longer time to which the blower would turn off or on. The user may turn the light on in the same manner.

The range hood may also be equipped with a sound- or voice-activated system that in one embodiment lets the user speak to the range hood and state what controls and operations the user wants. This provides the user the ability to operate hands free, therefore, allowing the user to do something else with their hands. Alternatively, the range hood can be hooked up to a PC computer or a whole house computer system for operation and control.

Another aspect of this invention is a range hood 50 designed with a temperature control or cooling element 172. See, e.g., FIG. 3. The element 172 is preferably secured to the inside of the cavity or remotely. In this one embodiment, heated air is circulated through the range hood and past the element to provide better heat control to the non-ducted range hood both inside the hood and inside the cooking room. The fan or blower provides air movement inside cavity. This system cools/heats the exhaust air before delivery of air to the room. Preferably, such a system is included with a non-vented unit. These systems are sometimes referred to as a "heat pump." Thus, such a heat pump may be used to make the range hood not only a venting hood, but a cooling/heating hood. This feature is important when larger range hoods are designed to recycle air back into the room. With the use of larger cook ranges, a large amount of heat is generated and returning this heated air to the room can be a big issue for the user. Here, the cooling/heating system is used for extracting effluents (like steam) and cooling of the drawn air to a proper temperature for return. The system may also include a device to select a precise return air temperature. For example, with the ability to cool and treat the exhaust air, this feature provides the user the ability to select the temperature of the returning treated air to the room, e.g. 70 degrees Fahrenheit. Humidity buildup in the cavity chamber may also be controlled by a power venting or condensation drainage system. The system may include an electric chill or a refrigerant such as that found in freezers, a circulating system to provide removal of heat, or an electric cooling heat exchanger.

As mentioned, the hood may have a vent cover that includes: louvers, holes, or slotted opening(s) for exhausting treated air. These may be closed off by a motor driven vent slide, bimetal device, solenoid, electromagnetic, or other electronically or electro-mechanically controlled shut off device. FIGS. 7-10 show a few of the embodiments of this feature. FIG. 9 shows an embodiment with gear teeth on it. Preferably, it is in contact with a stepper motor/ac motor/dc motor that controls the opening. Other devices that deliver motion, such as linear motion devices, wax motors, etc., may be used. The cover regulates the flow of air being exhausted or brought in. The vent cover may be fully opened or closed (sealed cavity), or opened to a varying degree to control heat or moisture build up. When used with a forced air (powered) re-circulating system, even greater control can be had. The damper or slide system allows for flows to be proportional thus controlling air movement and contaminated air for cleaning. One embodiment of a vent slide damper can be seen in FIG. 1. Even though this shows the slots on the side of the range hood, vents can be at the top, front, and at the bottom. The slots may be placed in or at any location on the range hood. It is readily apparent from the above description that the venting may be of any form that varies the opening. The vents may also be closed in the event of a fire on the range.

As noted above, the vents in one preferred embodiment provide fresh air for mixing. Here, the vents form a key part of an air recirculation system. For example, the fresh air may be brought in over the heated air being removed in an air-to-air heat exchange. This process reduces heat loss and overall temperature as air comes in from an external source.

In sum, the vents in such systems help control moisture, effluents (e.g., grease, oil, and particulates), airflow, and fire protection in the range hood. The vents may control not only intake, but also exhausting of the contaminated air from within the inside cavity of the range hood.

In accordance with another aspect of this invention, the range hood may be controlled by electronics and equipped with an AC or DC electronic temperature sensor located inside the hood or a chamber such that the temperature of the range hood can be detected accurately. Such controls provide control and operation response to sense temperature on the range or in the hood and then turn the exhausting functions on/off and adjust speed according to needs. Any electronic sensor used for detecting heat/temperature, CO, CO2, hydrocarbons, or power, for example, thermal detection device(s), may be used to control the exhaust. In one embodiment, the blower exhaust motors are electronically connected to a temperature-sensing device and is DC powered in accordance with requirements for the unit. Here the motor/blower is also protected in the event of a fire by an automatic turn off. The user may also select settings or preset settings for the electronic control(s) to maintain the desired exhaust flow within the hood's chamber. The sensing device helps maintain performance in a predetermined desired range of operating temperature(s) or set point(s). The sensor can be mounted on an electronic board or it can be attached by itself to any wall or location from which detection of the temperature can be made.

Detection of temperature may also be done by a number of methods such as Resistance Temperature Detectors (RTD), Thermistors, IC sensors, Radiation Sensors Thermometers, bimetallic, IR and thermocouples.

Temperature detection is accomplished preferably by at least one of a: resistance temperature detector (RTD), thermistor, IC sensor, radiation sensor, thermometer, bimetallic sensor, IR sensor, and/or thermocouple. RTDs provide low cost over other methods when used with electronics. Even though RTD sensors tend to be relatively slower in response than thermocouples, which are used in range hoods today, RTDs offer several advantages well know to those of ordinary skill in the art.

After the sensor 60 sends a signal, a conditioning device called a transmitter is used. This transmitter is used to convert the signal from the sensor to an electrical signal recognizable to the processing control board. The temperature transmitter may be of a type such as a four wire, three wire, or a two-wire type, but other methods can be used. The optimum form of connection of RTDs is a four-wire circuit. It removes the error caused by mismatched resistance of lead wires. A constant current is passed through each of the leads and a measurement for the voltage drop across the RTD is provided. With a constant current, the voltage is strictly a function of the resistance and a more true measurement is achieved. This method provides the best accuracy in detecting the temperature at or near the range hood.

One method for a sensor circuit uses a RTD temperature sensitive element to measure temperature from ambient to elevated temperatures. One of ordinary skill in the art is familiar with such sensor circuits, so the circuit is not shown. The information from the sensor circuit can be also displayed, processed for control of the motor, blower, and speeds. All of the above information can be made on a chip. This chip can be placed in an ideal area for detection of temperature. This circuitry preferably provides data/information to the control board for controlling functions of the range hood. Distributed temperature sensors that sense temperature at every point along an SS sheathed fiber and feature a resolution of 0.5 degree C. and a spatial resolution of 1.5 m may be used. The fiber can range up to 2,000 m and can be coiled at specific points of interest. Fiber can be sheathed with a nonconductive polymer for intrinsic applications. This method provides the ability to profile a range/cook top for detection of temperatures at many points. The strip may be along the complete front of a range hood trim at the edge. Response times are thus reduced and provide the control board the ability to sense the complete top of a target zone rather than just one zone. This also provides the manufacturers the ability to customize the zones placing more points in areas for detection. The use of electronics and sealed components allow theses systems to be used outdoors also.

Next generation fiber optic distributed temperature sensors (DTS) may be used to sense temperature at every point along an SS sheathed fiber. These feature a resolution of 0.5 degree C. and a spatial resolution of 1.5 m. The fiber may range up to 2,000 m and can be coiled at specific points of interest. The fiber may be sheathed with a nonconductive polymer for intrinsic applications. With this system, many locations for detection are provided. Response times are shorter and sensing of the complete top of a target zone rather than the one zone may occur. This also provides the manufacturers the ability to customize the zones by placing more points in areas for better detection.

Another aspect of the present invention is to have infinite fan speed adjustment levels. This can be done, for example, by having the user touch down on a glass resistance keypad until the speed required is reached. Once the speed is reached, the electronic control may reduce or completely cut off current/power to the blower(s)/fan(s). The keypad may have one or more keypad location(s) for operating the increase or decrease/on or off of the speed by the user. For example, three locations for independent operations can provide the user with better control. A display may show the user the speed level and may be used to assist in finding proper speeds, which then can be programmed in to the electronic control circuit for repeated operations later. Alternatively, the sensor 76 for the fan 72 may be connected to fan regulator 74 as shown in FIG. 4.

According to another embodiment of the present invention shown at FIG. 2, the range hood filter(s) preferably have a flow sensor 88 behind or in the filter 84 for the detecting of airflow and to greatly improve on the required servicing of the filter. The flow sensor 88 in the filter is in communication with an electronic control board. It detects the movement or reduced movement of air passing through the filter 84. This air movement can be set for limit(s) as to when the filter(s) need changing. These limits can be adjusted for the type of filters used, e.g., metal mesh, louvers, carbon filters or a combination of these types. Another way is to have the electronic control board set the limits automatically by setting/programmed a percentage of blockages. In some instances of reduced flow, the sensor may signal the control board to increase fan speed and thus increase flow.

The sensor 88 for airflow can range from the simplest and lowest cost types such as the strain gage on a reed. Here, the air moving across the reed bends the reed causing the strain gage to send a signal to the electronic control board. In one embodiment, as the air is reduced due to blockage, the signal changes and the electronic control board can signal the user to change the filter. Signaling the user can be by sound or by lights or other methods such as not operating or combinations of signals. Another low cost method is by magnetic(s). This would be very similar to the one above, but the sensor would be detecting a magnetic gain or loss.

Another sensor type is the differential pressure sensor, which has one open end on the outside of the filter(s) and another and behind the filters. The difference between the sensor openings can be signaled to the electronic control board, which then can watch for the changes either up or down or when a set point is reached. It then signals the user for change.

A micro bridge mass airflow sensor is another sensor, which operates on the theory of heat transfer. Mass airflow is directed across the surface of the sensing elements. Output voltage varies in proportion to the mass air or other gas flowing through the inlet and outlet ports of the package. A specially designed housing preferably directs and controls the airflow across the microstructure-sensing element. The microbridge mass airflow sensor uses temperature sensitive resistors deposited within a thin film of silicon nitride. The resistors are suspended in the form of two bridges over an etched cavity in the silicon. A chip may be preferably located in a precisely dimensioned airflow channel to provide repeatable flow response information. The small size and thermal isolation of the microbridge mass airflow sensor are responsible for the extremely fast response and the high sensitivity to flows.

In another embodiment, dual sensing elements positioned on both sides of a central heating element may be used to indicate flow direction as well as flow rate. Laser trimmed thick film and thin film resistors preferably provide consistent interchangeability from one device to the next. Other types of sensors are the: Solid State Hall effect sensors, piezoresistive sensors, calibrated pressure sensors, transducer, bonded element transducers, transmitters, ultrasonic, Doppler, IR, and fiber optic sensors.

According to another aspect of the present invention, the range hood may include a sensor for pot/pan or item detection on a target surface. See, e.g., FIG. 6, sensor 156. For example, an IR sensor may be used to collect a small amount of energy (usually 0.0001 watt) radiated from the target. It then generates an electrical signal that is amplified by a precision amplifier and then converted into a voltage output. A CPU digitizes the signal by an Analog-to-Digital Converter. Next, an Arithmetic Unit solves a temperature equation based on Planck's Radiation Law and compensates for the ambient temperature and emissivity. This results in a temperature reading within a fraction of a second after the user places the item in the target field. Using this technology, one can measure the temperature of one item or cover the complete cook top surface from a 5-meter distance as long as the field of view is filled by the target. Further, IR can operate in complete darkness. Also, many IR sensors can measure in the 8 um to 15 um wavelength band where the atmosphere is almost totally transparent. In the 8 um to 15 um wavelength band IR can penetrate PE film (for example: a plastic container or plastic film wrap). This, if some thing is hidden behind a PE film (such as a pan), the IR thermometer sensor can detect the presence of the object.

IR sensing can measure objects that move, rotate, or vibrate (e.g., boiling liquids). They do not damage or contaminate the surface of the object of interest. They measure the temperature of the actual product being used on a cook top or range and not some of the other part of the surface. Thermal conductivity of the object being measured such as glass, metal, wood, or even very thin objects does not present a problem, as is with other sensors. Response time is in the millisecond range, which gives the user more information per time period. The IR detector system can be used to detect for heat and fire protection and/or distance from the range hood.

Other sensors like photoelectric, photon, optics, indium-gallium-arsenide, and thermal detectors may be used in place of IR for the detection of items placed on the surface.

The range hood of this invention is designed for outdoor locations as well as indoor ones. The range hood design has the ability to weather outdoor temperatures and environment. For example, the use of electronics for range hood provides better sealing for these environments. Remote electronic controls not only provide convenient remote operations for use outdoors, but also reduce the effects for some of the environment on the controls. Further, electronics are not subject to the mechanical problems of turning in extreme weather conditions. They are also resistant to other environmental conditions.

As mentioned above, the range hood of the present invention is very versatile. For example, it may be built into/on a mobile island or cart; such as for use with grilling/cooking equipment. Alternatively, the hood itself may be a separate mobile unit, e.g., a frame that is self-supporting or free-standing. Such a mobile range hood may be, e.g., mounted on wheels and does not need to be installed into a cabinet or other unit to add structural support.

According to another aspect of the present invention is the novelty of using odor eliminations or scents for controlling odor or adding deodorants into the room. This may be accomplished by special coatings on the filters, adhesive stick on materials, or by a reservoir that is in communication with the moving air streams.

According to another aspect of the present invention, the range hood has the ability of being closed/folded up when the unit is no longer in use. Because a range hood normally stands out beyond the cabinets, in one embodiment the range hood folds up being flush with the cabinets next to the range hood. It is also possible to fold up the range hood in such away as to have the ability to have cabinet door close to cover the range hood, thus making it look like a cabinet instead of a hood when not in use. For example, the hood of the present invention may be stored behind a cabinet door and it may be pulled out. It may also be dropped down when in use. The hood may also be hinged rather than fixed allowing for the unit to be folded in and out of the way. Closing the hood behind a door will stop the airflow from leaving the room when not in use. In another embodiment, the range hood is hidden away by the closing of a sliding or rotating panel.

The ability to close off the range hood is helpful because this prevents air from being drawn out of the room containing the range hood when the unit is not in use. Thus, this feature provides energy saving for users that have ducted units. The closure may be manual or by powered operation.

According to another aspect of the present invention, the range hood of one embodiment also has the ability to be closed/folded in such a way to close off the under side cavity. Without such a closure, air may be drawn up even when the unit is no longer in use. In one embodiment, the range hood has fold up flaps that become flush with the underside of the range hood. In another embodiment, the flap 144 folds out to provide a larger outer profile when extended out. See FIG. 5. The flap can be folded a number of different ways including in half. In another embodiment, the range hood bottom has a motorized or manual slide for closure like a roll top desk. In one embodiment, a flue flap (like that for a conventional fire place) is provided for this closing. These designs may be smooth or textured to add a pleasing look. Such a closure also saves the user money by reducing heat loss from the room when not in use.

Another aspect of the present invention is a steam shield mounted on a back wall of the range hood. See FIG. 6, shield 146. Various methods for providing space behind the shield may be used. A shelf 148 may be mounted on the shield or panel for placing items on for storage such as spices or items to be warmed, e.g., warming lights from above may be used with such a shelf. In the case of a shield, it may cover the back wall and act as a back splash also. Further, the shield or panel may provide a channel for venting air back toward the cook top. The panel allows complete cook top perimeter coverage for the downwardly flowing air curtain created in one embodiment of the invention.

Another aspect of the present invention is remote control and/or sensing. See, e.g., FIG. 4. Here a remote sensing and receiving system includes a sensor(s) and or a remote receiver along with remote control panel 116 at a different location. The sensor(s) includes a transducer to sense a physical parameter on the cook top of range. The transducer will generate an electrical signal representative of the physical parameter and apply the data to a processor. In response, the processor drives a digital display, which produces visual indications of these parameters. The processor provides communication between the sensor(s) and the remote receiver which drives some operation by the range hood. For example, the receiving unit controls the range hood from signals for turning on, to adjusting the speed of the blowers. The sensor(s) and receiver(s) may both have a transmitter and receiver to enable communication through signals. This would be helpful when changing set points or detection points.

In one embodiment, the remote sensing and receiving system or detecting and display system is configured as a remote keypad. For example, the keypad apparatus preferably includes a display and a remote transducer unit having a temperature sensor unit or other transducer exposed to the cook top/range. The temperature sensor unit may be mounted near the cook top/range such that proper detection can be made. However, those skilled in the art will appreciate that the temperature sensor unit may assume any suitable location which allows it to sense the temperature on top of a range/cook top.

In another embodiment, the temperature sensor unit is configured to convert temperature readings into an electrical signal representative of the cook zone for transmission to the remote display/control unit. In response to such temperature signals, the data is displayed and transmission of operation requirements is sent to the range hood for processing various range hood functions that occur, such as, a blower fan is turned on, etc.

Physical parameters measured by remote sensing and receiving system are not limited to temperature. For example, a sensor/transducer may be used in extinguisher devices in which the quality of the air from a range is measured for CO, CO2 or other gasses for fire fighting. Note: Transducer Technology, Inc offers a T series carbon monoxide sensor using nano—particulate technology for sensing or an amperometric electrochemical sensor. In this embodiment, if a fire develops, the remote sensor and remote control devices can activate a fire extinguisher. Here, a microprocessor preferably controls the various circuits associated with this system. Various other devices may be coupled to such a microprocessor to control other fuictions within the range hood.

In another embodiment, a fire protection system may be included. See, e.g. FIG. 4, system 162. The fire protection system preferably has a warning device and a built in fire extinguisher. The fire detection system preferably also turns off the blower and other electronics and closes at least one vent. This feature prevents the spread of fire in and around a range hood. Further, critical temperature levels may be set by the factory so that when the sensors detect these present levels, the range hood activates the fire protection system.

Another feature of the present invention is preferably the use of display 122 located on a sliding panel, a rotating panel, or pop up panel. See FIG. 13. This ability to conceal the display 122 protects it from damage and provides a smooth looking surface. In one embodiment, this is accomplished by placing the electronic display on a rotating drum, a rotating L-shaped plate, or on a triangle shaped part. Once the operations are complete, the user or the downdraft system 20 can rotate the display 122. In one embodiment, the user can touch the front of the display 122 to activate movement. Once the electronics sense the pressure on the display 122, the rotation begins until it reaches the stop point. In this case, the stop point would be when the unit provides the smooth surface. The other way the display 122 may move to a closed position is if the display 122 and the range hood have been off for a time. Once that time has been reached, the display 122 returns back to the closed position. A motor or some other means of rotating the display 122 may be used to provide movement. Switches, stepper motor(s) or magnetism can be used for the location of stop points.

There are virtually innumerable uses for the present invention, all of which need not be detailed here. All the disclosed embodiments can be practiced without undue experimentation.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. In addition, the individual components need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Further, although various components as described herein as physically separate modules, it will be manifest that they may be integrated into the apparatus with which they are associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. An appliance including a range hood for a cook top having a heating element comprising a hood housing having a set of outer panels defining a cavity for venting at least one of air and effluent from the cook top;

a cover disposed within the hood housing and separating the cavity into an upper cavity and a lower cavity, the cover having a hole that is defined by a set of inner panels and wherein the inner panels are spaced from the outer panels such that a first channel and a second channel are defined by an outer surface of the cover and an inner surface of the hood housing, wherein the channels are configured to move air that passes from the lower cavity to the upper cavity back toward the cook top to create an air curtain around each side of the cook top;

a fan assembly having a fan mounted below the cover and aligned with the hole and above a heating element on the cook top;

a sensor to scan the cook top for an item placed thereon and provide feedback to operate the fan assembly;

a filter mounted below the fan assembly for removing a material from the effluent before the effluent is presented to the fan assembly; and a first plate and a second plate positioned above and extending parallel to the cover to define a pressure chamber;

wherein the air curtain prevents effluent from escaping from the hood.

2. The appliance of claim 1, further comprising:

means for adjusting fan speed; and a sensor for the range hood.

3. The appliance of claim 2, wherein the fan assembly includes at least one of: a regulator for electrical current to a blower motor such that the power output can be changed as needed, a tangential fan to circulate air downward, a cross flow fan, centrifugal fan, a fan that can be remotely located in attached duct work, a fixed speed fan, a variable speed fan to control air movement, a fan with adjustable speeds that may be preset, a fan used as a power vent for removing air, a fan for management of moisture build up and controlled by a humidity sensor, a re-circulating system, a mechanism for sucking air from the appliance top, a fan for management of heat build up and controlled by a heat sensor, and a fan to move air through a heat exchanger.

4. The appliance of claim 1, further comprising a keypad being at least one of the following: located on the range hood, located remotely, split into parts between the hood and another location, and matched to a size, appearance, and function of another neighboring appliance and the range hood.

5. The appliance of claim 1, further comprising a control board in at least one of the following locations: on the range hood, remotely, and split into several parts between the range hood and other locations and attached thereto.

6. The appliance of claim 1, further comprising at least one of: an output display, a rotating display, an LED display, a LCD display, a sliding panel, a retractable display, a removable display, a fixed display, an illuminated display that can be adjusted in color and intensity, a plasma display, a dot matrix display, a vacuum fluorescent display, and a pop up display.

7. The appliance of claim 1, further comprising:

a plate located below the channel and adjacent a wall;

a first vent for exhausting air in fluid communication with the cavity;

a second vent separate from the first vent to draw in outside air; and a race way to channel outside air and recycled air back toward the cook top.

8. An appliance including a range hood for a cook top having a heating element comprising a hood housing having a lower inner cavity for venting at least one of air and effluent from the cook top;

a vent cover between an upper cavity and the lower cavity, the vent cover having a hole;

a fan assembly having a fan mounted in the vent cover hole and above a heating element on the cook top;

a filter mounted adjacent the fan assembly for removing a material from the effluent;

an outer channel for moving air from the upper cavity back toward the cook top to create an air curtain around each side of the cook top, wherein the air curtain prevents effluent from escaping from the hood;

a means for adjusting fan speed and a sensor for the range hood; and a sensor to scan the cook top for an item placed thereon and provide feedback to operate the fan assembly.

9. A cooking appliance, comprising:

a cook top having at least one heating element;

a range hood disposed generally above the cook top and configured to create an air curtain around the cook top, wherein the range hood includes:

a plenum chamber having a first opening and a second opening, both openings defined generally normal to the cook top;

a pressure chamber positioned entirely above the plenum chamber;

a fan mounted to the plenum chamber and aligned with the first opening, the fan configured to move air presented to the plenum chamber to the pressure chamber;

a filter mounted to the plenum chamber and aligned with the second opening, and configured to remove material from the air presented to the plenum chamber;

a sensor to scan the cook top for an item placed thereon and provide feedback to operate the fan; and a flow path in fluid communication with the pressure chamber and open to the cook top, and wherein the flow path is defined between the plenum chamber and the pressure chamber and circulates air from the pressure chamber back to the cook top such that the air curtain is formed around the cook top.

10. The cooking appliance of claim 9 further comprising means for adjusting a speed of the fan.

11. The cooking appliance of claim 9 further comprising a light element disposed within the plenum chamber and configured to illuminate the cook top.

12. The cooking appliance of claim 9 further comprising a control pad having at least one user input, the control pad mounted to the range hood.

13. The cooking appliance of claim 9 wherein the cook top has at least four heating elements.

14. The cooking appliance of claim 9 further comprising at least one of: an output display, a rotating display, an LED display, a LCD display, a sliding panel, a retractable display, a removable display, a fixed display, an illuminated display that can be adjusted in color and intensity, a plasma display, a dot matrix display, a vacuum fluorescent display, and a pop up display.

15. The cooking appliance of claim 9 further comprising a vent positioned above the pressure chamber and in fluid communication with the pressure chamber.

16. The cooking appliance of claim 15 wherein the vent includes a vent cover, and further comprising a plurality of vent holes defined in the vent cover.

17. The cooking appliance of claim 9 further comprising at least one restrictor plate to prevent air from escaping the range hood.

18. The cooking appliance of claim 17 wherein at least one restrictor plate defines a top panel of the plenum chamber and has a plurality of openings to permit air to flow from the plenum chamber to the pressure chamber.

19. The cooking appliance of claim 17 wherein the at least one restrictor plate is oriented along a plane that is generally normal to an axis along which air is discharged from the flow path.

* * * * *